US009953583B2

(12) United States Patent
Yoon et al.

(10) Patent No.: US 9,953,583 B2
(45) Date of Patent: Apr. 24, 2018

(54) ORGANIC LIGHT EMITTING DIODE DISPLAY DEVICE INCLUDING PIXEL DRIVING CIRCUIT

(71) Applicant: LG DISPLAY CO., LTD., Seoul (KR)

(72) Inventors: Sanghun Yoon, Geoje-si (KR); ChangHeon Kang, Paju-si (KR); JungMin Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/790,895

(22) Filed: Jul. 2, 2015

(65) Prior Publication Data

US 2016/0005384 A1 Jan. 7, 2016

(30) Foreign Application Priority Data

Jul. 4, 2014 (KR) ..... 10-2014-0084053

(51) Int. Cl.
*G09G 3/30* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0819* (2013.01); *G09G 2300/0852* (2013.01); *G09G 2300/0861* (2013.01); *G09G 2310/0256* (2013.01); *G09G 2320/0214* (2013.01); *G09G 2320/0223* (2013.01)

(58) Field of Classification Search
CPC ..... G09G 3/3291; G09G 3/3233; G09G 2300/0819; G09G 2320/0223; G09G 2300/0861; G09G 2310/0256; G09G 2320/0214; G09G 2300/0852
See application file for complete search history.

(56) References Cited

U.S. PATENT DOCUMENTS

2004/0130539 A1 7/2004 Yabu et al.
2005/0237283 A1 10/2005 Ozawa et al.
2007/0273620 A1* 11/2007 Yumoto ..... G09G 3/3233 345/76
2010/0079357 A1* 4/2010 Ozawa ..... G09G 3/3233 345/46
2011/0310077 A1* 12/2011 Hwang ..... G09G 3/3233 345/211
2012/0169794 A1 7/2012 Uchino et al.
2013/0093800 A1* 4/2013 Shim ..... G09G 3/3233 345/690
2014/0049531 A1 2/2014 Kwak
(Continued)

FOREIGN PATENT DOCUMENTS

KR 10-2004-045341 A 6/2004
KR 10-2012-0072816 A 7/2012
(Continued)

*Primary Examiner* — Kwang-Su Yang
(74) *Attorney, Agent, or Firm* — Dentons US LLP

(57) ABSTRACT

An apparatus comprising a circuit configured to control anode voltages of one or more adjacent pixel rows, which are adjacent to an Nth pixel row, to achieve minimal voltage differences between said Nth pixel row and said adjacent pixel rows to suppress luminance drops in an OLED display by minimizing leakage currents being introduced from adjacent pixel rows.

16 Claims, 23 Drawing Sheets

(56) References Cited

U.S. PATENT DOCUMENTS

| | | | | |
|---|---|---|---|---|
| 2015/0103060 | A1* | 4/2015 | Yamashita | G09G 3/3233<br>345/211 |
| 2016/0203758 | A1* | 7/2016 | Tsuge | G09G 3/3258<br>345/211 |
| 2016/0351120 | A1* | 12/2016 | Itakura | G09G 3/3233 |

FOREIGN PATENT DOCUMENTS

| | | | |
|---|---|---|---|
| KR | 10-2013-0029992 | A | 3/2013 |
| KR | 10-2013-0055450 | A | 5/2013 |

* cited by examiner

ORGANIC LIGHT EMITTING DIODE DISPLAY DEVICE INCLUDING PIXEL DRIVING CIRCUIT

CROSS-REFERENCE TO RELATED APPLICATIONS

This application claims the priority of Korean Patent Application No. 10-2014-0084053 filed on Jul. 4, 2014, in the Korean Intellectual Property Office, the disclosure of which is incorporated herein by reference.

BACKGROUND

Technical Field

The present disclosure relates to an organic light emitting diode (hereinafter, referred to as "OLED") display device.

Description of the Related Art

Each of a plurality of pixels constituting an OLED display device includes an OLED having an organic light emitting layer between an anode and a cathode and a pixel circuit that independently drives the OLED. The pixel circuit includes a switching thin film transistor (hereinafter, referred to as "TFT"), a capacitor, and a driving TFT. The switching TFT charges the capacitor with a data voltage in response to a scan pulse. The driving TFT regulates emission of the OLED by controlling the amount of current supplied to the OLED according to the data voltage charged in the capacitor.

Such an OLED display device is comprised of an X*Y matrix including x number of pixel rows and y number of column unit pixels on a screen. That is, each horizontal pixel row is comprised of y number of pixels and each vertical pixel row is comprised of x number of pixels. The OLED display device displays an image in a single frame by writing data in order from a first pixel row to a lowermost xth row unit pixel on a screen.

Meanwhile, in the organic light emitting layer constituting the OLED, a hole injection layer and a hole transporting layer adjacent to the anode is configured as a common single layer in all of the pixels constituting the OLED display device. However, while the OLED display device writes data to the first pixel row through the lowermost pixel row in order, there is a time when a voltage difference is generated between anodes of adjacent pixels. Due to a voltage difference in anode between a pixel including a high-potential anode and a pixel including a low-potential anode, an unintended leakage current flows toward the pixel including a low-potential anode through the common single layer. The leakage current may cause a set value of a data voltage applied to an Nth horizontal pixel row to be deviated from the manufacturer's intention. Such a data voltage deviation caused by the leakage current becomes a big problem when a resistance of the common single layer decreases.

Meanwhile, in the OLED display device, a problem occurs as pixels may have different driving TFT threshold voltages Vth and mobility due to process variation. Further, a voltage drop of a high-potential voltage VDD occurs, causing an amount of current driving the OLED to be changed. Thus, a luminance deviation is generated between pixels. Generally, an initial driving TFT characteristic deviation generates stain or patterns on a screen and a driving TFT characteristic deviation due to deterioration that occurs over time when driving the OLED reduces the lifespan of an OLED display panel or generates a residual image. Accordingly, there have been continued attempts to reduce a luminance deviation between pixels and thus improve an image quality by introducing a compensation circuit that compensates a driving TFT characteristic deviation and a drop voltage of a high-potential voltage VDD.

SUMMARY

The present disclosure is conceived to solve the above-described problem. In the present disclosure, an apparatus comprising a circuit configured to control anode voltages of one or more adjacent pixel rows, which are adjacent to an Nth pixel row, to achieve minimal voltage differences between said Nth pixel row and said adjacent pixel rows to suppress luminance drops in an OLED display by minimizing leakage currents being introduced from adjacent pixel rows. The circuit configured to set said anode voltages of said one or more adjacent pixel rows to be equal to or less than an anode voltage of said Nth pixel row when said Nth pixel row is operating in a sampling period or in a programming period among driving operation periods of said OLED display.

second scan signal

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE PREFERRED EMBODIMENT

Hereinafter, an OLED display device and a method for driving the same according to an exemplary embodiment of the present disclosure will be described in detail with reference to the accompanying drawings.

A thin film transistor (TFT) employed in the present disclosure may be of a P type or an N type. In the following exemplary embodiment, there will be described a case where a TFT is of an N type, for convenience in explanation. In this regard, a gate high voltage VGH is a gate-on voltage to turn on a TFT, and a gate low voltage VGL is a gate-off voltage to turn off a TFT. In explaining pulse type signals, a gate high voltage (VGH) state is defined as a "high state", and a gate low voltage (VGL) state is defined as a "low state".

Figure 1:
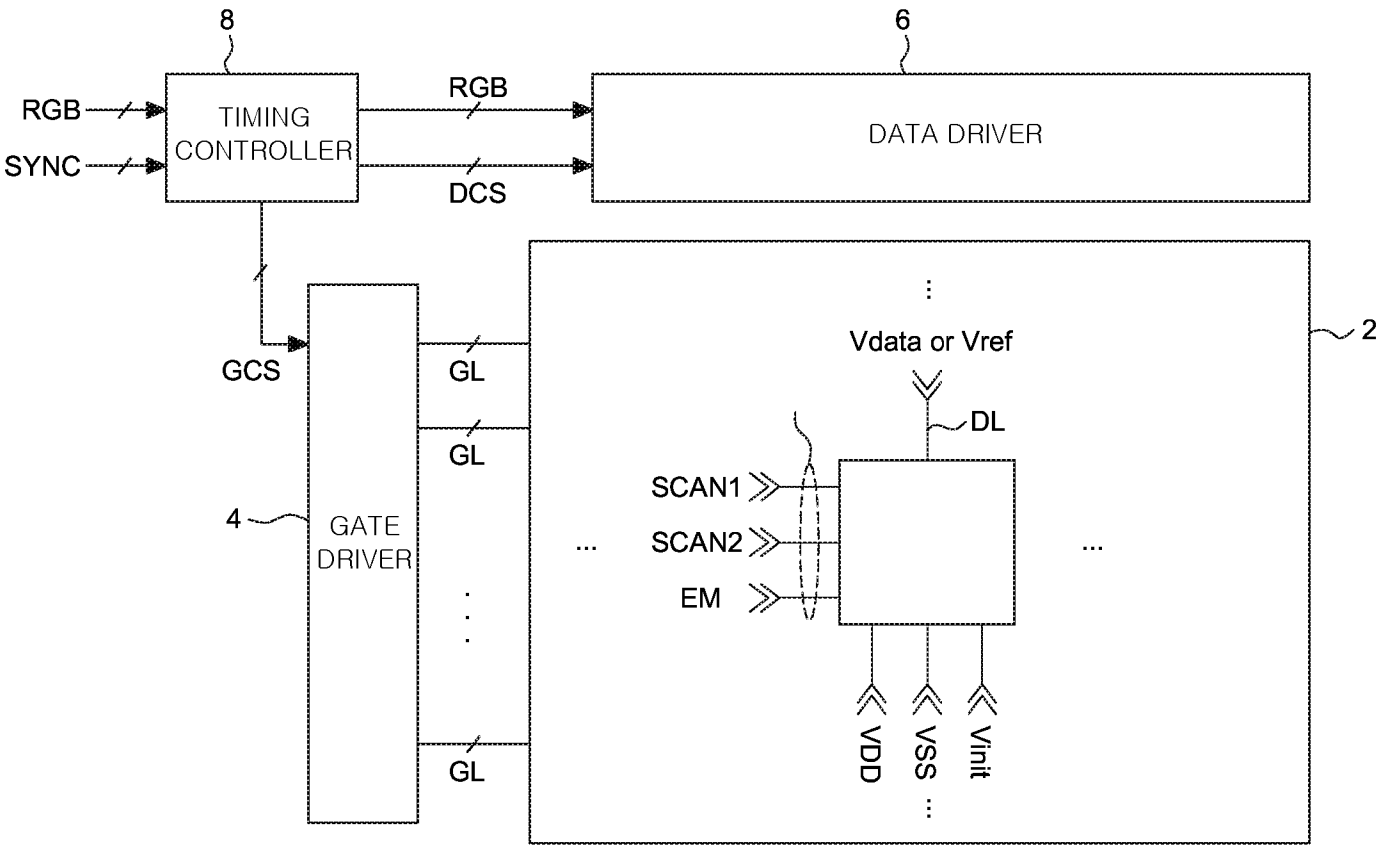
FIG. 1 is a configuration view of an OLED display device according to an exemplary embodiment of the present disclosure.

FIG. 1 is a configuration view of an OLED display device according to an exemplary embodiment of the present disclosure.

As illustrated in FIG. 1, the OLED display device includes a display panel 2 including a plurality of pixels P defined in accordance with intersection of a plurality of gate lines GL and a plurality of data lines DL, a gate driver 4 for driving the plurality of gate lines GL, a data driver 6 for driving the plurality of data lines DL, and a timing controller 8 for arranging image data RGB input from the outside, supplying the arranged image data RGB to the data driver 6, and outputting gate control signals GCS and data control signals DCS to control the gate driver 4 and data driver 6.

Each pixel P includes an OLED and a pixel driving circuit including a driving TFT DT configured to supply a drive current to the OLED. Each pixel driving circuit independently drives the OLEDs of the respective pixels P. Further, the pixel driving circuit is configured to compensate for a characteristic deviation between the driving TFTs DTs and compensate for a voltage drop of a high-potential voltage VDD. Thus, it is possible to reduce a luminance deviation between the pixels P. The pixels P according to the present disclosure will be described in detail with reference to FIGS. 2 to 6.

The display panel 2 includes the plurality of gate lines GL and the plurality of data lines DL intersecting each other. The pixels P are disposed in intersection regions of the gate lines GL and the data lines DL. Each pixel P includes a pixel driving circuit including an OLED. Further, each pixel P is connected to gate lines GL, a data line DL, a high-potential voltage (VDD) supply line, a low-potential voltage (VSS) supply line, and an initialization voltage (Vinit) supply line.

The gate driver 4 supplies a plurality of gate signals to the plurality of gate lines GL in response to a plurality of gate control signals GCS supplied from the timing controller 8. The plurality of gate signals includes first and second scan signals SCAN1 and SCAN2, and an emission signal EM. These signals are supplied to each pixel P by the plurality of gate lines GL. A high-potential voltage VDD has a higher level than a low-potential voltage VSS. The low-potential voltage VSS may be a ground voltage. An initialization voltage Vinit has a lower level than a threshold voltage of the OLED of each pixel P.

The data driver 6 converts digital image data RGB input from the timing controller 8 into a data voltage Vdata in response to a plurality of data control signals DCS supplied from the timing controller 8, using a reference gamma voltage. Further, the data driver 6 supplies the converted data voltage Vdata to the plurality of data lines DL. Meanwhile, the data driver 6 outputs the data voltage Vdata only in a programming period t3 (refer to FIG. 2) of each pixel P. In a period other than the programming period, the data driver 6 outputs a reference voltage Vref.

The timing controller 8 aligns the externally input image data RGB so as to be matched to the size and resolution of the display panel 2, and then supplies the aligned image data to the data driver 6. The timing controller 8 generates a plurality of gate control signals GCS and a plurality of data control signals DCS by using synchronization signals SYNC input from the outside, for example, a dot clock DCLK, a data enable signal DE, a horizontal synchronization signal Hsync, and a vertical synchronization signal Vsync. Further, the timing controller 8 supplies the generated gate control signals GCS and data control signals DCS to the gate driver 4 and data driver 6, respectively, in order to control the gate driver 4 and data driver 6.

Hereinafter, each pixel P according to an exemplary embodiment of the present disclosure will be described in more detail with reference to FIG. 2 to FIG. 4.

Figure 2:
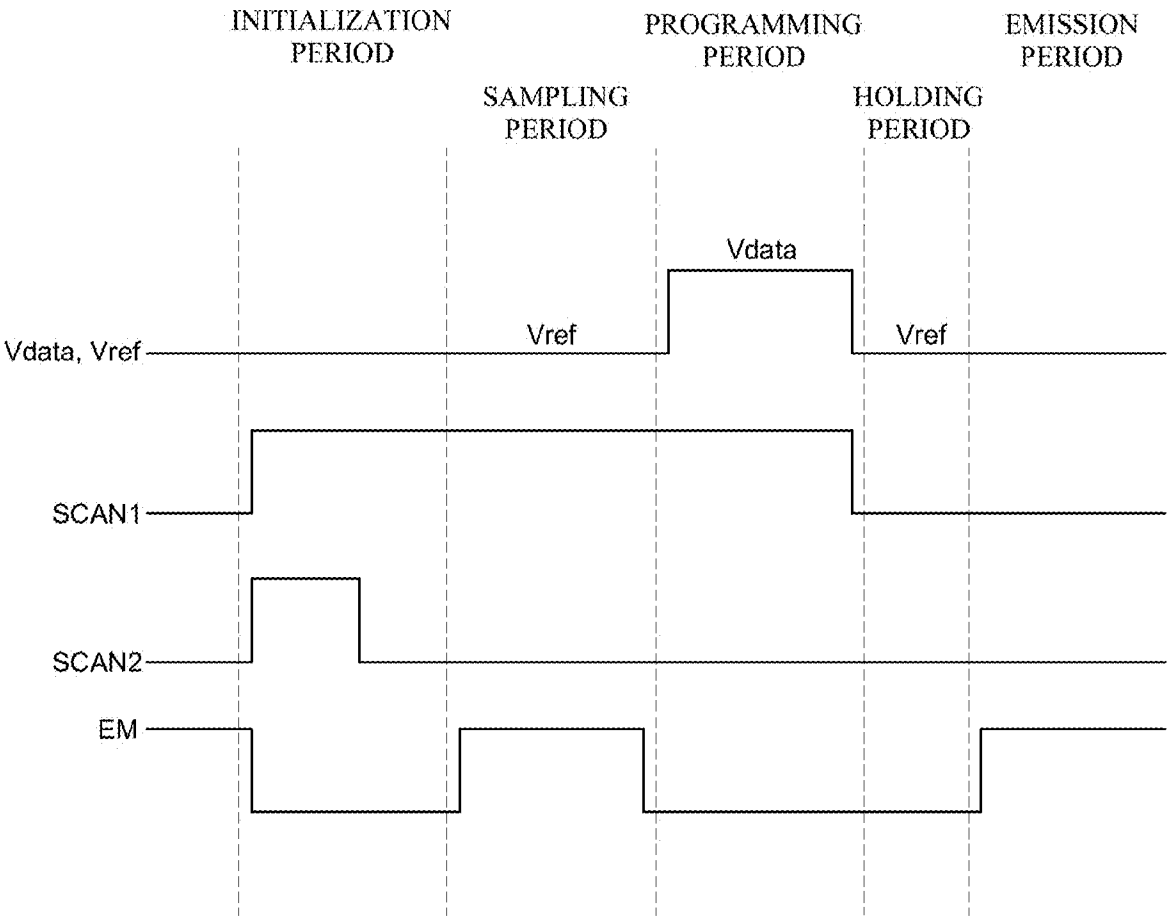
FIG. 2 is a driving waveform diagram of each pixel P illustrated in FIG. 1.

Referring to FIG. 2, each pixel P according to an exemplary embodiment of the present disclosure operates in a plurality of periods divided into an initialization period t1, a sampling period t2, a programming period t3, a holding period t4, and an emission period t5, in response to pulse timings of a plurality of gate signals supplied to the pixel P.

The initialization period t1 may include a first initialization period t11. In the first initialization period t11, a voltage difference between a gate node (a first node N1 in FIG. 3) and a source node (a second node N2 in FIG. 3) of a driving TFT in the pixel P has a higher value than a threshold voltage of the driving TFT. For example, as for the pixel P driven by the pixel driving circuit according to a circuit diagram of FIG. 3, in the first initialization period t11, when the first scan signal SCAN1 is output at a high state, the second scan signal SCAN2 may be output at a high state and then output at a low state, and the emission signal EM may be output at a low state at the same time.

Meanwhile, the initialization period t1 may include a second initialization period t12 in addition to the first initialization period t11. In the second initialization period t12, a voltage applied between an anode and a cathode of the OLED has a lower value than a threshold driving voltage of the OLED. Herein, the threshold driving voltage of the OLED means a minimum voltage for driving the OLED. The threshold driving voltage of the OLED is a unique value of the OLED depending on a design of the OLED (a kind of a material, an interfacial characteristic, a thickness, and the like). When the first initialization period t11 does not arrive yet, the second initialization period t12 may start. For example, as for the pixel P driven by the pixel driving circuit according to the circuit diagram of FIG. 3, in the second initialization period t12, when the first scan signal SCAN1 is output at a low state, the second scan signal SCAN2 may be output at a high state and the emission signal EM may be output at a low state at the same time.

In the sampling period t2, a threshold voltage of the driving TFT in the pixel P is sensed or sampled. For example, as for the pixel P driven by the pixel driving circuit according to the circuit diagram of FIG. 3, in the sampling period t2, the first scan signal SCAN1 and emission signal EM may be output at a high state and the second scan signal SCAN2 may be output at a low state at the same time.

In the programming period t3, the pixel P writes data to a capacitor. For example, as for the pixel P driven by the pixel driving circuit according to the circuit diagram of FIG. 3, in the programming period t3, the first scan signal SCAN1 may be output at a high state and the second scan signal SCAN2 and emission signal EM may be output at a low state at the same time.

The holding period t4 is a period between the programming period t3 and the emission period t5. For example, as for the pixel P driven by the pixel driving circuit according to the circuit diagram of FIG. 3, in the holding period t4, all of the first scan signal SCAN1, the second scan signal SCAN2, and the emission signal EM may be output at a low state.

In the emission period t5, the pixel P is supplied with a current corresponding to the written data and emits light. For example, as for the pixel P driven by the pixel driving circuit according to the circuit diagram of FIG. 3, in the emission period t5, the emission signal EM may be output at a high state and the first and second scan signals SCAN1 and SCAN2 may be output at a low state.

Meanwhile, the data diver 6 supplies data voltage Vdata to the plurality of data lines DL in sync with the programming period t3 of each pixel P. In periods other than the programming period t3, the data driver 6 supplies a reference voltage Vref to the plurality of data lines DL.

Figure 3:
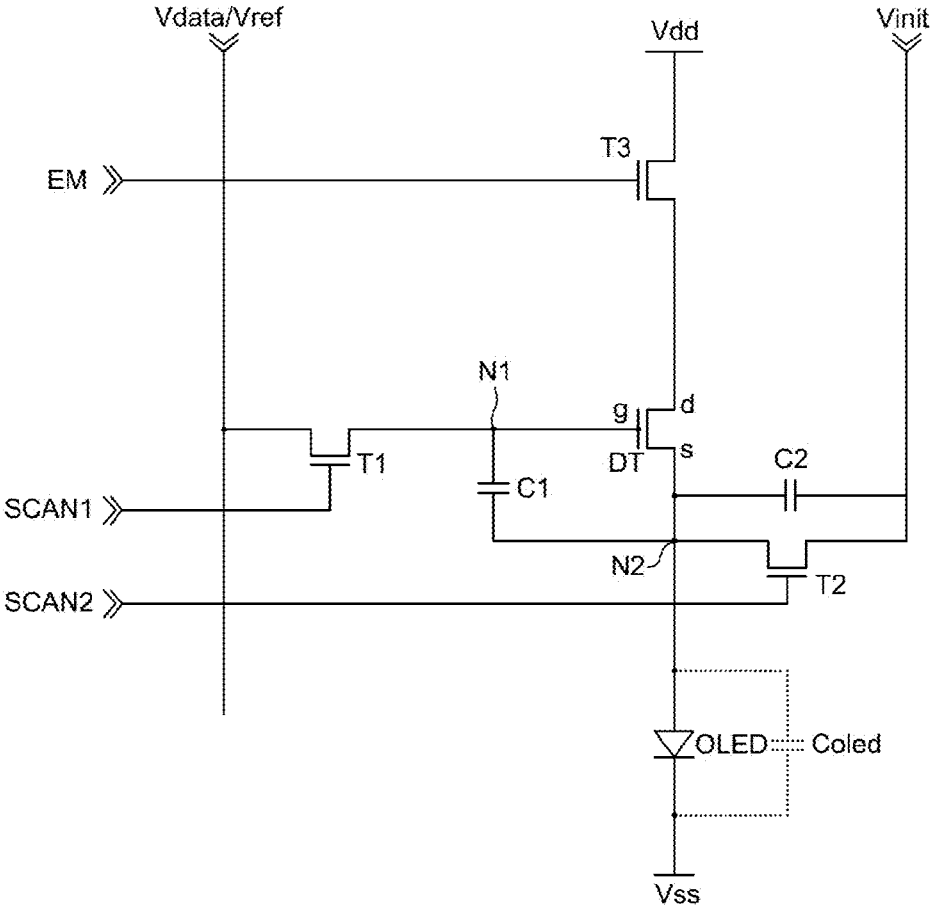
FIG. 3 is a circuit diagram of each pixel P illustrated in FIG. 1.

Referring to FIG. 3, each pixel P includes an OLED and a pixel driving circuit including four TFTs and two capacitors, to drive the OLED. To be specific, the pixel driving circuit includes a driving TFT DT, first to third TFTs T1 to T3, and first and second capacitors C1 and C2.

The driving TFT DT is connected to the OLED in series in between the VDD supply line and the VSS supply line. In the emission period t5, the driving TFT DT supplies a drive current to the OLED.

The first TFT T1 is turned on or off in response to the first scan signal SCAN1. When the first TFT T1 is turned on, the data line DL is connected with a first node N1 connected with a gate of the driving TFT DT. The first TFT T1 supplies, to the first node N1, the reference voltage Vref supplied from the data line DL in the initialization period t1 and sampling period t2. Further, in the programming period t3, the driving TFT DT supplies, to the first node N1, the data voltage Vdata supplied from the data line DL.

The second TFT T2 is turned on or off in response to the second scan signal SCAN2. When the second TFT T2 is turned on, the initialization voltage (Vinit) supply line is connected with a second node N2 connected with a source of the driving TFT DT. The second TFT T2 supplies, to the second node N2, the initialization voltage Vinit supplied from the Vinit supply line in the initialization period t1.

The third TFT T3 is turned on or off in response to the Emission signal EM. When the third TFT T3 is turned on, the high-potential voltage (VDD) supply line is connected with a drain of the driving TFT DT. In the sampling period t2 and emission period t5, the third TFT T32 supplies, to the drain of the driving TFT DT, the high-potential voltage VDD supplied from the VDD supply line.

The first capacitor C1 is disposed between the first node N1 and the second node N2 so as to connect the first node N1 with the second node N2. The first capacitor C1 stores the threshold voltage Vth of the driving TFT DT in the sampling period t2.

Figure 4A:
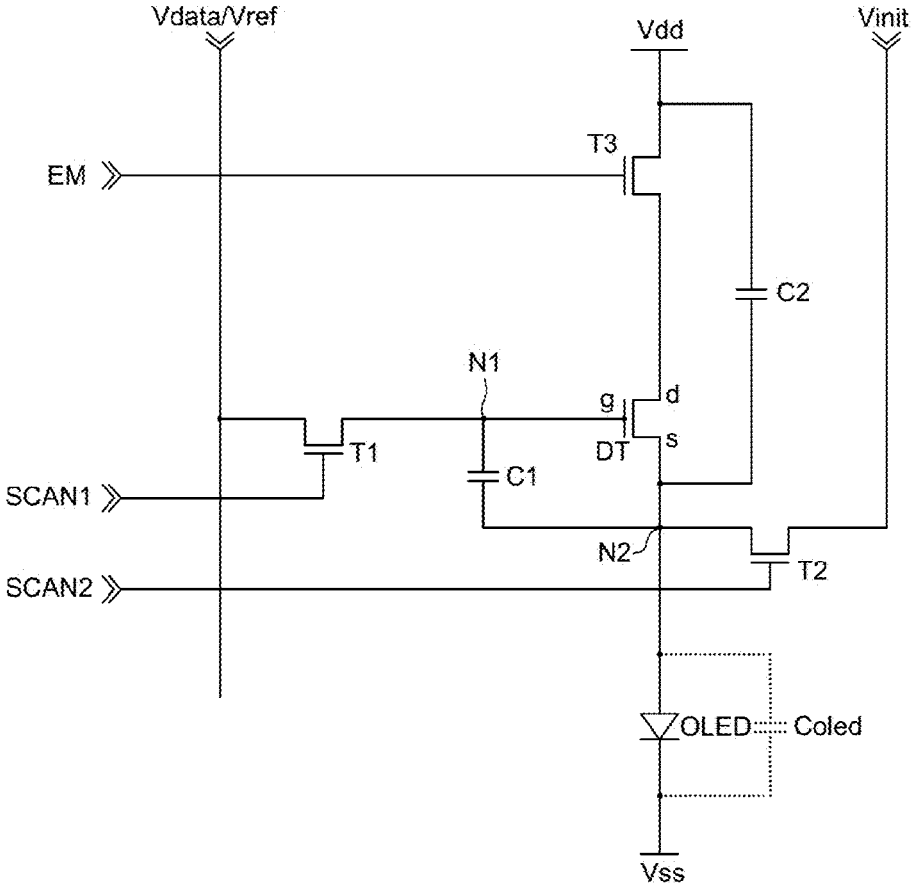
FIGS. 4*a* and 4*b* are circuit diagrams of each pixel P according to other exemplary embodiments of the present disclosure, respectively.
Figure 4B:
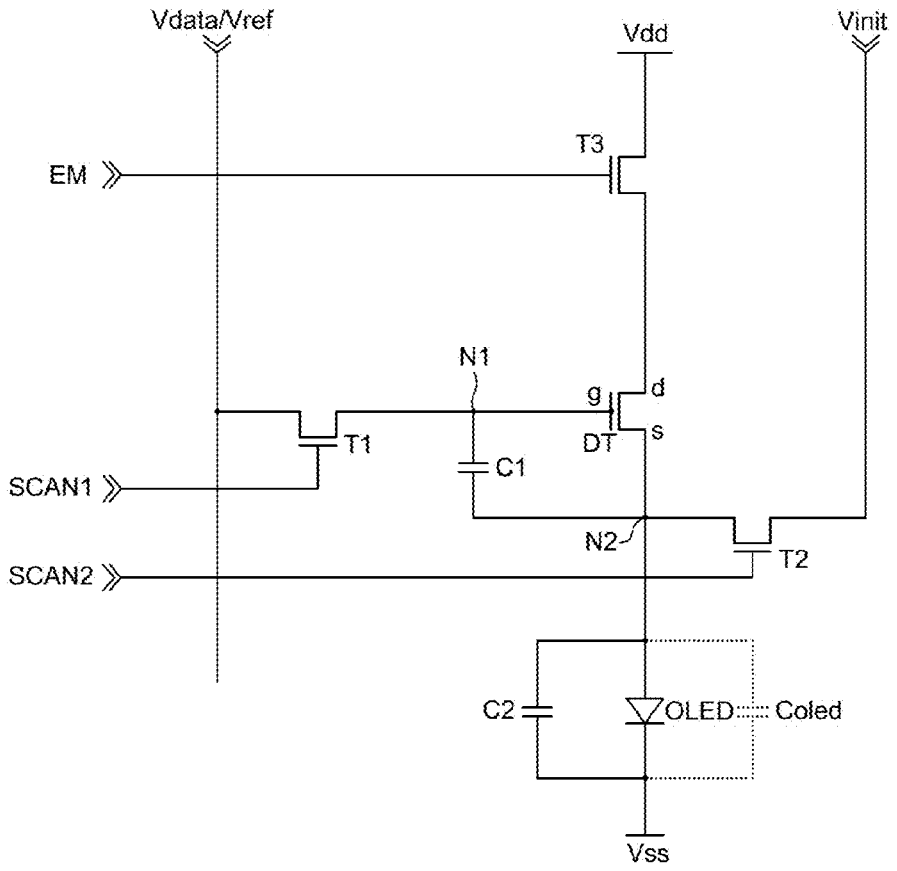

The second capacitor C2 is disposed between the Vinit supply line and the second node N2 so as to connect the Vinit supply line with the second node N2. The second capacitor C2 is connected to the first capacitor C1 in series and thus relatively reduces a capacity ratio of the first capacitor C1. Thus, the second capacitor C2 functions to enhance the luminance of the OLED with respect to the data voltage Vdata applied to the first node N1 in the programming period t3. Meanwhile, as illustrated in FIG. 4*a*, the second capacitor C2 may be disposed between the VDD supply line and the second node N2 so as to connect VDD supply line with the second node N2. Alternatively, as illustrated in FIG. 4*b*, the second capacitor C2 may be disposed between the VSS supply line and the second node N2 so as to connect the VSS supply line with the second node N2.

Hereinafter, a method for driving each pixel P according to an exemplary embodiment of the present disclosure will be described with reference to FIGS. 2 and 3.

First, in the initialization period t1 (without, for example, the second initialization period t12), the first and second TFTs T1 and T2 are turned on in the first initialization period t11. Then, the reference voltage Vref is supplied to the first node N1 via the first TFT T1, and the initial voltage Vinit is supplied to the second node N2. As a result, the pixel P is initialized. The initialization period t1 refers to a period before the third TFT T3 is turned on, and in this period, the second TFT T2 is turned off.

Subsequently, in the sampling period t2, the first and third TFTs T1 and T3 are turned on. Then, the first node N1 maintains the reference voltage Vref. And, when the drain of the driving TFT DT is floated, the high-potential voltage VDD is applied to the drain of the driving TFT DT. At the same time, a current flows from the drain toward the source of the driving TFT DT. When a source voltage of the driving TFT DT is equal to "Vref-Vth", the driving TFT DT is turned off. Herein, "Vth" represents the threshold voltage of the driving TFT DT. In this period, the third TFT T3 is turned off.

Thereafter, in the programming period t3, the third TFT T3 is turned off and the first TFT T1 sustains the turn-on state. Then, the data voltage Vdata is supplied to the first node N1 via the first TFT T1 in the turn-on state.

As a result, the voltage of the second node N2 is changed to "Vref−Vth+C' (Vdata−Vref)" due to a coupling phenomenon caused by voltage distribution according to in-series connection of the first and second capacitors C1 and C2. Herein, "C'" represents "C1/(C1+C2+Coled)". "Coled" represents the capacitance of the OLED. In accordance with the present disclosure, the capacity ratio of the first capacitor C1 is relatively reduced since the second capacitor C2 connected in series with the first capacitor C1 is provided. Accordingly, it is possible to enhance the luminance of the OLED with respect to the data voltage Vdata applied to the first node N1 in the programming period t3.

Then, in the holding period t4, no TFT is turned on. That is, the first TFT T1 is turned off and the second and third TFTs T2 and T3 sustain the turn-off state. As a result, the data voltage Vdata and the threshold voltage written to the pixel P in the programming period t3 are maintained. That is, the holding period t4 refers to a period after the programming period t3 and before the emission period t5.

Subsequently, in the emission period t5, the third TFT T3 is turned on. Then the high-potential voltage VDD is applied to the drain of the driving TFT DT via the third TFT T3. As a result, the driving TFT DT supplies a drive current to the OLED. In this case, the drive current supplied from the driving TFT DT to the OLED is expressed by an expression "$K(Vdata-Vref-C'(Vdata-Vref))^2$". Referring to this expression, it can be seen that the drive current of the OLED is not influenced by the threshold voltage Vth of the driving TFT DT and the high-potential voltage VDD. Accordingly, it is possible to reduce a luminance deviation between the pixels P by compensating for a driving TFT characteristic deviation in each pixel P and a voltage drop of the high-potential voltage VDD. Meanwhile, in accordance with the present disclosure, it may be possible to compensate for a mobility deviation between the driving TFTs DT by adjusting an ascending time of the emission signal EM transitioning from a low state to a high state at a starting point of the emission period t5.

The inventors of the present disclosure found that a luminance drop generated when the pixel P is driven by a method of the prior art is caused by a leakage current between the anodes of the adjacent pixels P. This will be described in more detail with reference to FIG. 5*a*, FIG. 5*b*, FIG. 6*a*, and FIG. 6*b*.

Figure 5A:
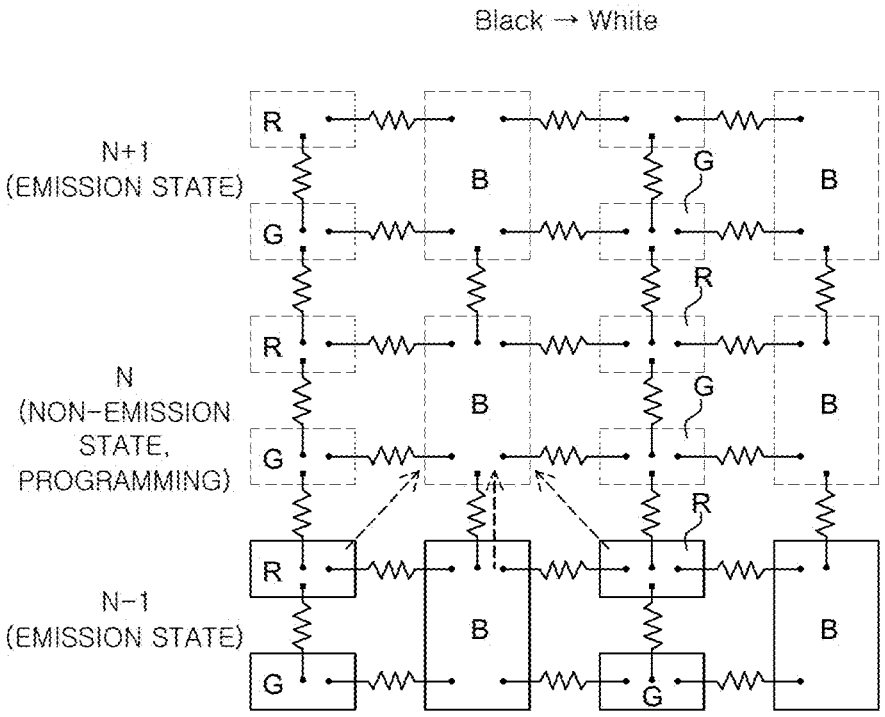
FIG. 5*a* is a schematic diagram illustrating an inflow direction of a leakage current introduced to an Nth pixel row corresponding to an Nth gate line of a first scan signal SCAN1 from pixel rows (for example, N−2th, N−1th, N+1th, and N+2th pixel rows) adjacent to the Nth pixel row while a frame in a display panel of an OLED display device realizes a black image and a next frame realizes a white image.

FIG. 5*a* is a schematic diagram illustrating an inflow direction of a leakage current introduced to an Nth pixel row corresponding to an Nth gate line of a first scan signal SCAN1 from pixel rows (for example, N−2th, N−1th, N+1th, and N+2th pixel rows) adjacent to the Nth pixel row while a frame in a display panel of an OLED display device realizes a black image and a next frame realizes a white image.

Figure 5B:
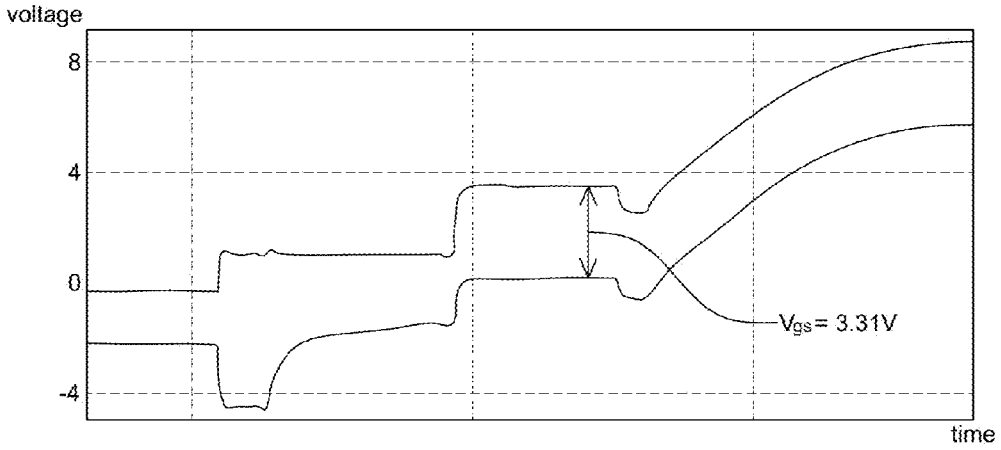
FIG. 5*b* is a graph illustrating a simulation result of a Vgs value in an Nth pixel row corresponding to an Nth gate line of a first scan signal SCAN1 while a frame in a display panel of an OLED display device realizes a black image and a next frame realizes a white image.

FIG. 5*b* is a graph illustrating a simulation result of a Vgs value in an Nth pixel row corresponding to an Nth gate line of a first scan signal SCAN1 while a frame in a display panel of an OLED display device realizes a black image and a next frame realizes a white image.

Figure 6A:
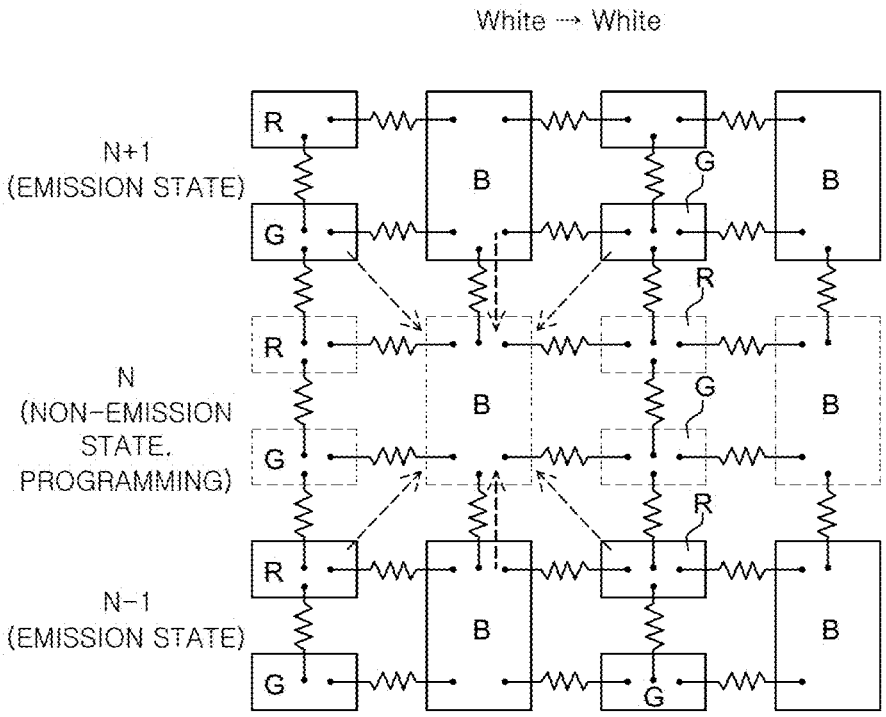
FIG. 6*a* is a schematic diagram illustrating an inflow direction of a leakage current introduced to an Nth pixel row corresponding to an Nth gate line of a first scan signal SCAN1 from pixel rows (for example, N−2th, N−1th, N+1th, and N+2th pixel rows) adjacent to the Nth pixel row while a frame in a display panel of an OLED display device realizes a white image and a next frame also realizes a white image.

FIG. 6*a* is a schematic diagram illustrating an inflow direction of a leakage current introduced to an Nth pixel row corresponding to an Nth gate line of a first scan signal SCAN1 from pixel rows (for example, N−2th, N−1th, N+1th, and N+2th pixel rows) adjacent to the Nth pixel row while a frame in a display panel of an OLED display device realizes a white image and a next frame also realizes a white image.

Figure 6B:
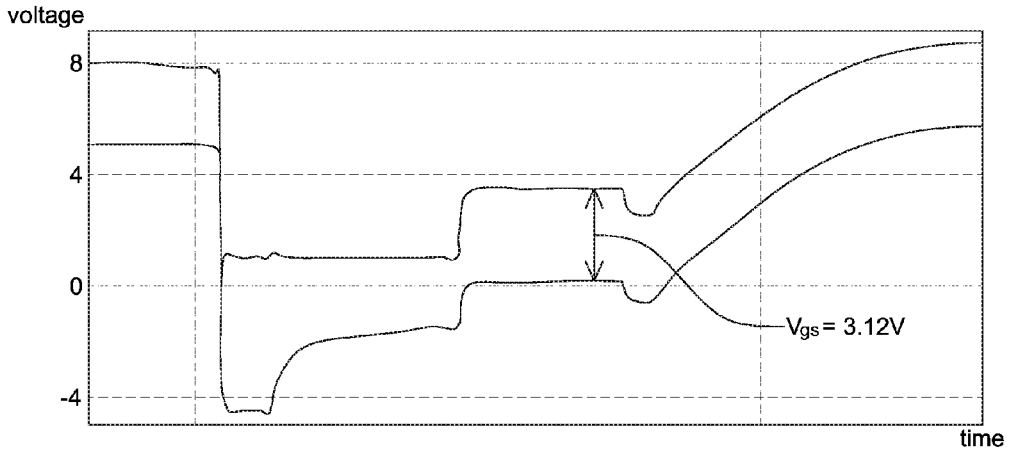
FIG. 6*b* is a graph illustrating a simulation result of a Vgs value in an Nth pixel row corresponding to an Nth gate line of a first scan signal SCAN1 while a frame in a display panel of an OLED display device realizes a white image and a next frame also realizes a white image.

FIG. 6*b* is a graph illustrating a simulation result of a Vgs value in an Nth pixel row corresponding to an Nth gate line of a first scan signal SCAN1 while a frame in a display panel of an OLED display device realizes a white image and a next frame also realizes a white image.

An Nth pixel row shares a hole injection layer and a hole transporting layer of an organic light emitting layer as a so-called common layer with adjacent pixel rows (for example, an N−1th pixel row and an N+1th pixel row and their subsequent adjacent pixel rows).

Meanwhile, while data are written to the Nth pixel row, pixel rows (for example, N−1th and N−2th pixel rows) before the Nth pixel row display an image corresponding to data desired to be displayed on a corresponding frame, and pixel rows (for example, N+1th and N+2th pixel rows) after the Nth pixel row display an image corresponding to data desired to be displayed on a previous frame. FIG. 5*a* and FIG. 6*a* illustrate inflow directions of a leakage current introduced to an Nth pixel row from pixel rows (for example, N−2th, N−1th, N+1th, and N+2th pixel rows) adjacent to the Nth pixel row in a case where data are written to the Nth pixel row to emit a light in a display panel of an OLED display device. FIG. 5*a* corresponds to a case where a frame in a display panel realizes a black image and a next frame realizes a white image, and FIG. 6*a* corresponds to a case where a frame realizes a white image and a next frame also realizes a white image.

While data are written to the Nth pixel row, an anode voltage of the Nth pixel row is lowered to be equal to or less than a cathode voltage in order not to allow a current to flow to the OLED. In this case, as compared with a voltage applied to an anode of the Nth pixel row, a voltage applied to anodes of adjacent pixel rows are relatively high. Therefore, a voltage difference is generated between the anode of the Nth pixel row and the anodes of its adjacent pixel rows.

To be more specific, referring to FIG. 5*a*, if a frame of a display panel realizes a black image and a next frame realizes a white frame, an N+1 pixel row realizes a black state (i.e., a non-emission state) of the frame, and, thus, an anode voltage is low. However, an N−1th pixel row realizes a white state (i.e., an emission state typically with a luminance of 300 nit) of the next frame, and, thus, an anode voltage of the N−1th pixel row is relatively higher than the anode voltage of the N+1th pixel row. Therefore, a difference between the voltage applied to the anode of the Nth pixel row and the voltage applied to the anode of the N+1th pixel row is not great. Thus, a leakage current from the N+1th pixel row to the Nth pixel row flows in a small amount, whereas a difference between the voltage applied to the anode of the Nth pixel row and the voltage applied to the anode of the N−1th pixel row is relatively very great, and, thus, a leakage current from the N−1th pixel row to the Nth pixel row flows in a large amount. In other words, a large amount of leakage current is introduced from the high-potential anode of the N−1th pixel row to the low-potential anode of the Nth pixel row via the common layer of the organic light emitting layer. Referring to FIG. 5*b*, it can be seen that in the programming period t3 of the Nth pixel row, a voltage value of the second node is not constant but exhibits a slight increase. Vgs as a voltage difference between the first node (gate node) and the second node (source node) of the driving TFT DT is 3.31 V. The slight increasing of the voltage value of the second node is due to the leakage current.

Meanwhile, referring to FIG. 6*a*, if a frame of a display panel realizes a white image and a next frame also realizes a white frame, an N+1 pixel row and an N−1th pixel row are in a white state, and, thus, an anode voltage of the N+1th pixel row and an anode voltage of the N−1th pixel row are high. Therefore, a difference between the voltage applied to the anode of the Nth pixel row and the voltage applied to the anode of the N−1th pixel row is great and a difference between the voltage applied to the anode of the Nth pixel row and the voltage applied to the anode of the N+1th pixel row is also very great. Thus, a large amount of leakage current is introduced from the high-potential anodes of the N−1th and N+1th pixel rows to the low-potential anode of the Nth pixel row (i.e., in a positive direction) via the common layer of the organic light emitting layer. Referring to FIG. 6*b*, it can be seen that in the programming period t3 of the Nth pixel row, a voltage value of the second node is not constant but exhibits a slight increase. In this case, Vgs is 3.12 V.

By comparing FIG. 5*b* and FIG. 6*b*, Vgs (for example, 3.12 V) in the case where a frame of a display panel realizes a white image and a next frame also realizes a white image is lower than Vgs (for example, 3.31 V) in the case where a frame of a display panel realizes a black image and a next frame realizes a white image. That is, it can be seen that an influence of a leakage current is greater in the case where a frame of a display panel realizes a white image and a next frame also realizes a white image as compared with the case where a frame of a display panel realizes a black image (i.e., a non-emission state) and a next frame realizes a white image (i.e., an emission state typically with a luminance of 300 nit). As a result, it can be seen that while data are written to an Nth pixel row, when pixel rows adjacent to the Nth pixel row are in an emission state, as anode voltages of the adjacent pixel rows increase, an influence of a leakage current increases.

Meanwhile, when FIG. 5*a* and FIG. 6*a* are described, only an influence of N−1th and N+1th pixel rows most adjacent to an Nth pixel row has been described for convenience in explanation. However, actually, the present disclosure is not limited thereto. N−2th and N+2th pixel rows or N−3th or N+3th pixel rows also have an influence. In other words, as a pixel row is more adjacent to the Nth pixel row, the pixel row has a greater influence on the Nth pixel row, and as a pixel row is less adjacent to the Nth pixel row, the pixel row has a smaller influence on the Nth pixel row.

The following is the reason why a leakage current flows when there is a voltage difference between anodes of adjacent pixel rows. An Nth pixel row shares a hole injection layer and a hole transporting layer of an organic light emitting layer as a so-called common layer with adjacent pixel rows (for example, an N−1th pixel row and an N+1th pixel row and their subsequent adjacent pixel rows). However, the hole injection layer and the hole transporting layer of the organic light emitting layer are connected with an anode of an OLED. Therefore, if there is a voltage difference between an anode of the Nth pixel row and anodes of its adjacent pixel rows, a current flows through a so-called common layer.

Such a flow of a leakage current is increased as a resistance of the common layer is decreased. Further, particularly when the common layer is doped with a small amount of impurity in order to improve the element performance of the OLED, a flow of a leakage current is increased. Since the impurity has conductivity, as a doping concentration of the impurity is increased, a resistance of the common layer is decreased, and, thus, a larger amount of leakage current is generated. If a doping concentration is lowered in consideration of a leakage current, it is impossible to improve the element performance of the OLED.

In other words, in order to minimize inflow of a leakage current, an increase in resistance may be considered. However, such an approach may deteriorate the element performance of an OLED.

Thus, the inventors of the present disclosure conceived a method for driving an OLED display device, which solves a leakage current problem simply by manipulating a method for driving a pixel driving circuit without undergoing any modification in a structure of an OLED element or a structure of the pixel driving circuit. This will be described in detail below. When applying the spirit of the present invention that the voltage of an anode in each pixel is controlled in order to make other adjacent pixel rows to realize a non-luminous condition when the Nth pixel row is in the programming period t3, there is no limit on the kind of pixel driving circuit.

FIGS. 7, 9, 11, and 13 are schematic diagrams illustrating that when an Nth pixel row corresponding to an Nth gate line of a first scan signal SCAN1 in a display panel of an OLED display device is in a sampling period t2 or a programming period t3, pixel rows (for example, N−2th, N−1th, N+1th, and N+2th pixel rows) adjacent to the Nth pixel row is in an emission state according to an exemplary embodiment of the present disclosure.

FIGS. 8*a*, 8*b*, 10*a*, 10*b*, 12*a*, 12*b*, 14*a*, and 14*b* respectively corresponding to FIGS. 7, 9, 11, and 13 are driving waveform diagrams illustrating a driving method of an Nth pixel row corresponding to an Nth gate line of a first scan signal SCAN1 in a display panel of an OLED display device and pixel rows (for example, N−2th, N−1th, N+1th, and N+2th pixel rows) adjacent to the Nth pixel row according to an exemplary embodiment of the present disclosure.

At a time when an Nth pixel row corresponding to an Nth gate line of a first scan signal SCAN1 in a display panel of an OLED display device moves on from a frame to a next frame, if an Nth pixel row is driven in the sampling period t2 or in the programming period t3, a voltage which is lower than a voltage applied to a cathode of an OLED is applied to a second node. That is, a voltage lower than a cathode voltage is applied to the anode of the OLED in the Nth pixel row. Therefore, the Nth pixel row is in a non-emission state in the sampling period t2 or in the programming period t3. In this case, adjacent pixel rows are set to be in a non-emission state, and, thus, a leakage current introduced from the adjacent pixel rows to the Nth pixel row is minimized. To be more specific, when the Nth pixel row is in the sampling period t2 or in the programming period t3, anode voltages of the adjacent pixel rows are set to be equal to or less than an anode voltage of the Nth pixel row in order to suppress a voltage difference. Thus, a leakage current introduced from the adjacent pixel rows to the Nth pixel row is minimized. According to this method, for example, when the Nth pixel row is in the sampling period t2 or in the programming period t3, (1) an N−1th pixel row is in the holding period t4, (2) an N+1th pixel row is in the first initialization period t11, in the second initialization period t12, or in both the first initialization period t11 and the second initialization period t12.

Figure 7:
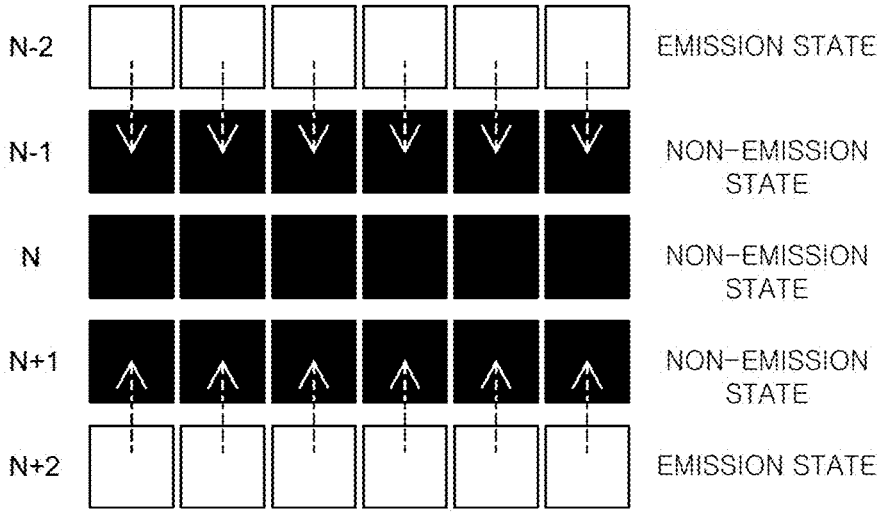
FIGS. 7, 9, 11, and 13 are schematic diagrams illustrating that when an Nth pixel row corresponding to an Nth gate line of a first scan signal SCAN1 in a display panel of an OLED display device is in a sampling period t2 or a programming period t3, pixel rows (for example, N−2th, N−1th, N+1th, and N+2th pixel rows) adjacent to the Nth pixel row is in an emission state according to an exemplary embodiment of the present disclosure.

FIG. 7 illustrates a case where when an Nth pixel row is in the sampling period t2 or in the programming period t3, N−1th and N+1th pixel rows among its adjacent pixel rows are in a non-emission state. Herein, a dotted arrow indicates an inflow route of a leakage current. Although FIG. 7 illustrates a line comprised of six pixels and five lines including an Nth pixel row and previous and subsequent two lines most adjacent to the Nth pixel row, it is obvious that such illustration is provided only for convenience in explanation and a configuration of lines and columns is not limited thereto.

To be more specific, when the Nth pixel row is in the sampling period t2 or in the programming period t3, (1) the N−1th pixel row is in the holding period t4, (2) the N+1th pixel row is in any one of the first initialization period t11 and the second initialization period t12, or in the first initialization period t11 and the second initialization period t12.

Figure 8A:
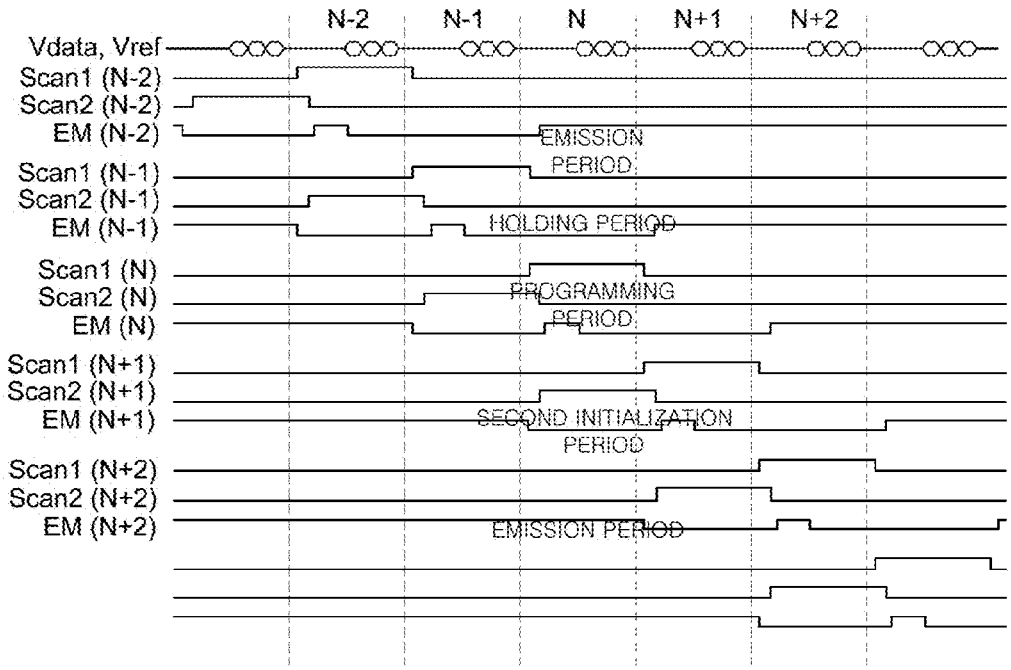
FIGS. 8*a*, 8*b*, 10*a*, 10*b*, 12*a*, 12*b*, 14*a*, and 14*b* respectively corresponding to FIGS. 7, 9, 11, and 13 are driving waveform diagrams illustrating a driving method of an Nth pixel row corresponding to an Nth gate line of a first scan signal SCAN1 in a display panel of an OLED display device and pixel rows (for example, N−2th, N−1th, N+1th, and N+2th pixel rows) adjacent to the Nth pixel row according to an exemplary embodiment of the present disclosure.
Figure 8B:
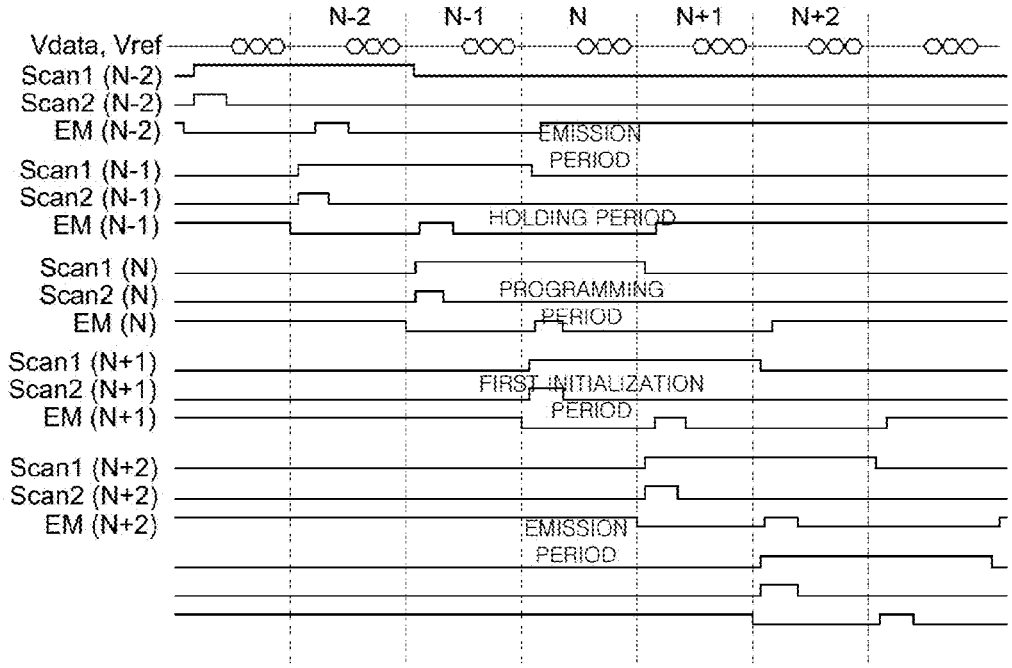

FIG. 8*a* and FIG. 8*b* are driving waveform diagrams illustrating a driving method of an Nth pixel row and pixel rows (for example, N−2th, N−1th, N+1th, and N+2th pixel rows) adjacent to the Nth pixel row. FIG. 8*a* and FIG. 8*b* are driving waveform diagrams for driving a display panel as illustrated in FIG. 7 if a pixel P adopts a 4T2C structure illustrated in FIG. 3 as a pixel driving circuit. This is just an example. The driving method according to an exemplary embodiment of the present disclosure as illustrated in FIG. 7 can also be applied to a pixel driving circuit of any other structure which drives a display panel as illustrated in FIG. 7 and operates in the initialization period t1, the sampling period t2, the programming period t3, the holding period t4, and the emission period t5 as described with reference to FIG. 2.

Referring to FIG. 8*a*, a driving timing may be controlled such that when the Nth pixel row is in the sampling period t2 or in the programming period t3, the N−1th pixel row is in the holding period t4 and the N+1th pixel row is in the second initialization period t12.

Here, the first initialization period t11, in which a voltage difference between the first node N1 and the second node N2 of the driving TFT DT is higher than a threshold voltage of the driving TFT DT, corresponds to a period from when a TFT configured to allow the first scan signal SCAN1 to flow and a TFT configured to allow the second scan signal SCAN2 to flow are turned on at the same time to before a TFT configured to allow the Emission signal EM to flow is turned on. In this case, the TFT configured to allow the second scan signal SCAN2 to flow may be turned off before the TFT configured to allow the Emission signal EM to flow is turned on or may be turned off at the same time as when the TFT configured to allow the Emission signal EM to flow is turned on.

Further, the second initialization period t12, in which an anode voltage of the OLED is lower than an OLED driving voltage, corresponds to a period from when the TFT configured to allow the second scan signal SCAN2 to flow is turned on to before the TFT configured to allow the first scan signal SCAN1 to flow is turned on. The second initialization period t12 may be present earlier in time than the first initialization period t11, but cannot be present later in time than the first initialization period t11. That is, it is possible to drive from the second initialization period t12 to the first initialization period t11, but impossible to drive from the first initialization period t11 to the second initialization period t12. The same explanation for the first initialization period t11 and the second initialization period t12 applies to FIGS. 10, 12, and 14.

That is, referring to FIG. 8*a*, a driving timing may be controlled such that the second initialization period t12 starts earlier than the first initialization period t11 in each pixel P constituting a display panel of an OLED display device.

Referring to FIG. 8*b*, a driving timing may be controlled such that when the Nth pixel row is in the sampling period t2 or in the programming period t3, the N−1th pixel row is in the holding period t4 and the N+1th pixel row is in the first initialization period t11. In other words, a driving timing may be controlled such that each pixel P constituting a display panel of an OLED display device goes through the first initialization period t11 without the second initialization period t12.

If each pixel P constituting a display panel of an OLED display device goes through the second initialization period t12 between the emission period t5 and the first initialization period t11, a voltage (for example, an initialization voltage Vinit) lower than the threshold voltage of the driving TFT DT is already applied to the second node N2 of the driving TFT DT in the pixel before the first initialization period t11. As compared with (1) a case where each pixel P constituting a display panel of an OLED display device goes through only the first initialization period t11 as the initialization period t1, in (2) a case where the pixel P goes through the second initialization period t12 in addition to the first initialization period t11 as the initialization period t1, a period in which an anode voltage is lower than a voltage applied to the driving TFT DT is increased by the second initialization period t12. Thus, it is possible to effectively suppress inflow of a leakage current to an Nth pixel row.

If a pixel P adopts a 4T2C structure illustrated in FIG. 3 as a pixel driving circuit, the first initialization period t11 and the second initialization period t12 cannot be completely overlapped in time. However, if a pixel P adopts a pixel driving circuit of another structure, the first initialization period t11 and the second initialization period t12 may be completely overlapped in time, i.e., the initialization period t1 may be the first initialization period t11 or the second initialization period t12. That is, the first initialization period t11 and the second initialization period t12 may start and end at the same time. In other words, each pixel P may be driven such that an anode voltage of an OLED is lower than an OLED driving voltage while a voltage difference between a gate node and a source node of a driving TFT in each pixel P is higher than a threshold voltage of the driving TFT.

Figure 9:
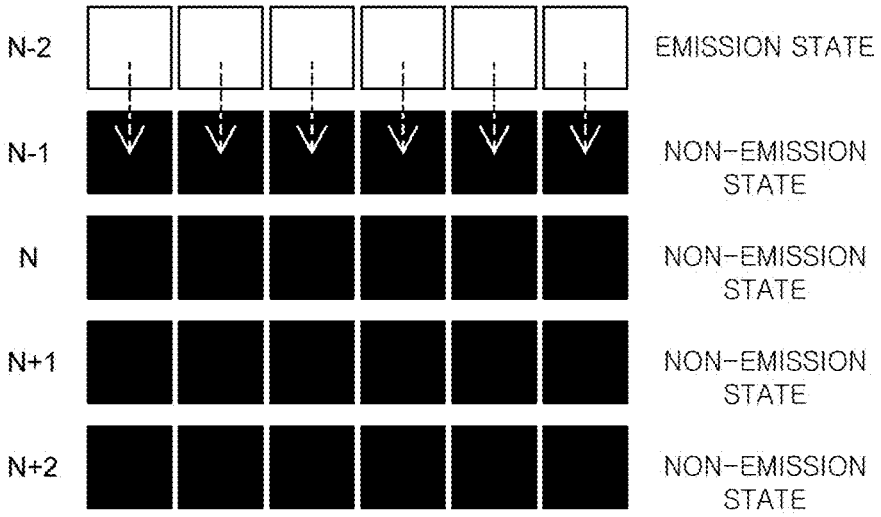

Then, FIG. 9 illustrates a case where when an Nth pixel row is in the sampling period t2 or in the programming period t3, N−1th, N+1th, and N+2 pixel rows among its adjacent pixel rows are in a non-emission state. Herein, a dotted arrow indicates an inflow route of a leakage current. Although FIG. 9 illustrates a line comprised of six pixels and five lines including an Nth pixel row and previous and subsequent two lines most adjacent to the Nth pixel row, it is obvious that such illustration is provided only for convenience in explanation and a configuration of lines and columns is not limited thereto.

To be more specific, when the Nth pixel row is in the sampling period t2 or in the programming period t3, (1) the N−1th pixel row is in the holding period t4, (2) the N+1th pixel row and the N+2th pixel row are in any one of the first initialization period t11 and the second initialization period t12, or in the first initialization period t11 and the second initialization period t12.

Figure 10A:
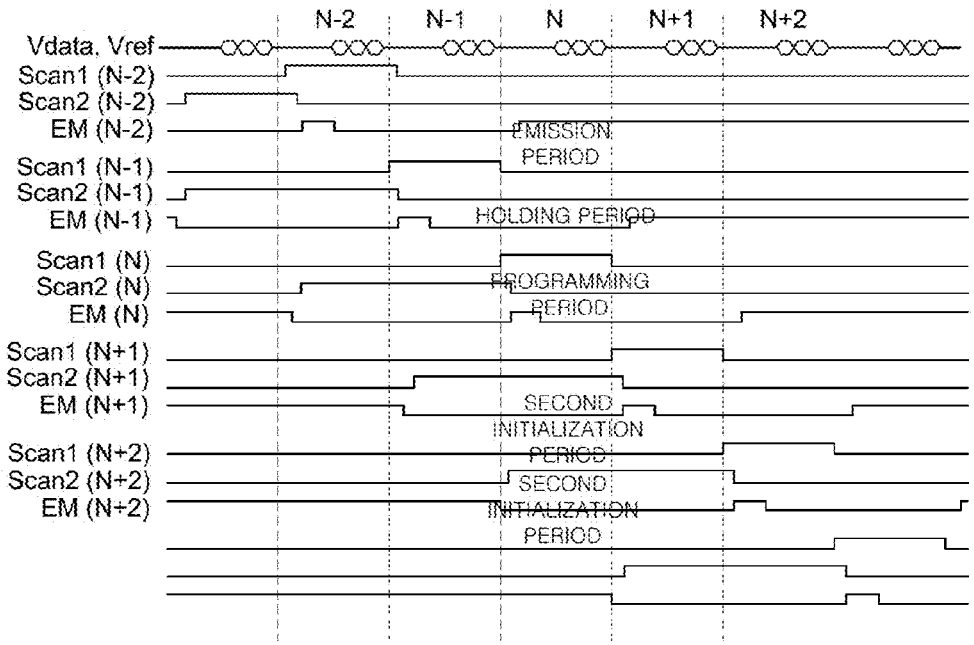
Figure 10B:
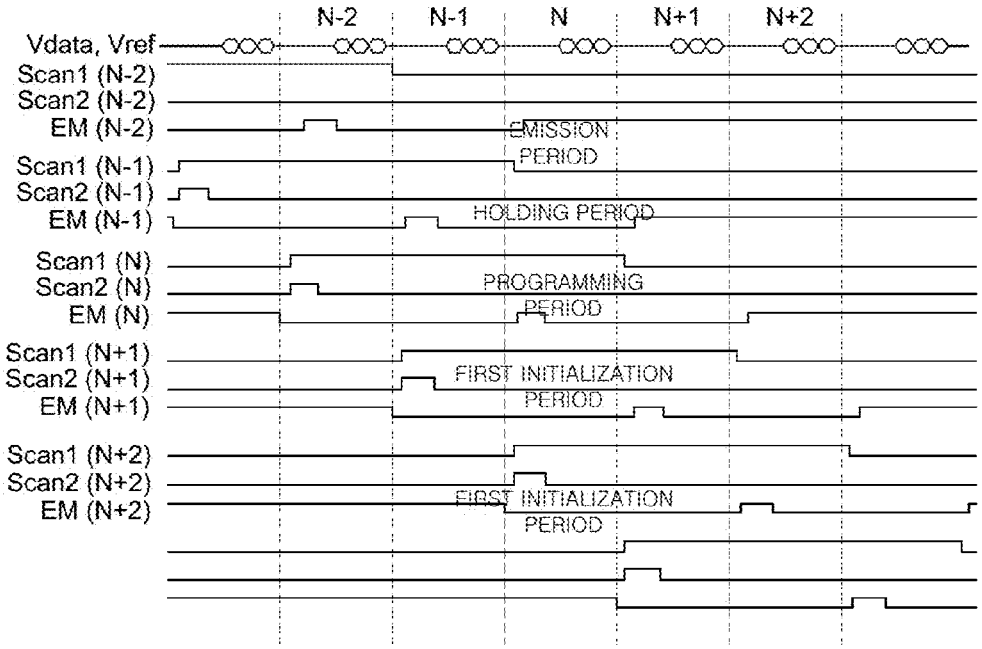

FIG. 10*a* and FIG. 10*b* are driving waveform diagrams illustrating a driving method of an Nth pixel row and pixel rows (for example, N−2th, N−1th, N+1th, and N+2th pixel rows) adjacent to the Nth pixel row. FIG. 10*a* and FIG. 10*b* are driving waveform diagrams for driving a display panel as illustrated in FIG. 9 if a pixel P adopts a 4T2C structure illustrated in FIG. 3 as a pixel driving circuit. That is, this is just an example, and the driving method according to an exemplary embodiment of the present disclosure as illustrated in FIG. 9 can also be applied to a pixel driving circuit of any other structure which drives a display panel as illustrated in FIG. 9 and operates in the first initialization period t11, the second initialization period t12, the initialization period t1, the sampling period t2, the programming period t3, the holding period t4, and the emission period t5 as described with reference to FIG. 2.

Referring to FIG. 10*a*, a driving timing may be controlled such that when the Nth pixel row is in the sampling period t2 or in the programming period t3, the N−1th pixel row is in the holding period t4 and all of the N+1th and N+2th pixel rows are in the second initialization period t12.

That is, a driving timing may be controlled such that each pixel P constituting a display panel of an OLED display device goes through the second initialization period t12 over two horizontal periods 2H. Herein, a horizontal period 1H refers to a period obtained by dividing a period allotted for displaying a single frame by M if a display panel is comprised of M gate lines of first scan signals SCAN1 to display the single frame. The two horizontal periods 2H are twice the horizontal period 1H.

Further, referring to FIG. 10*a*, a driving timing may be controlled such that the second initialization period t12 of the Nth pixel row constituting a display device of an OLED display device to start before writing the sampling period t2 of the N−1th pixel row.

Otherwise, referring to FIG. 10*a*, a driving timing may be controlled such that the second initialization period t12 starts earlier than the first initialization period t11 in each pixel P constituting a display panel of an OLED display device. However, in any case, the first initialization period t11 does not end earlier than the second initialization period t12.

Referring to FIG. 10*b*, a driving timing may be controlled such that when the Nth pixel row is in the sampling period t2 or in the programming period t3, the N−1th pixel row is in the holding period t4 and all of the N+1th and N+2th pixel rows are in the first initialization period t11.

That is, referring to FIG. 10*b*, a driving timing may be controlled such that each pixel P constituting a display panel of an OLED display device goes through the first initialization period t11 over the two horizontal periods 2H.

Further, referring to FIG. 10*b*, a driving timing may be controlled such that the first initialization period t11 of the Nth pixel row constituting a display panel of an OLED display device to start before writing the sampling period t2 of the N−1th pixel row.

Otherwise, referring to FIG. 10*b*, a driving timing may be controlled such that each pixel P constituting a display panel of an OLED display device goes through only the first initialization period t11.

If a pixel P adopts a 4T2C structure illustrated in FIG. 3 as a pixel driving circuit, the first initialization period t11 and the second initialization period t12 cannot be completely overlapped in time. However, if a pixel P adopts a pixel driving circuit of another structure, the first initialization period t11 and the second initialization period t12 may be completely overlapped in time, i.e., the initialization period t1 may be the first initialization period t11 or the second initialization period t12. That is, the first initialization period t11 and the second initialization period t12 may start and end at the same time. In other words, each pixel P may be driven such that an anode voltage of an OLED is lower than an OLED driving voltage while a voltage difference between a gate node and a source node of a driving TFT in each pixel P is higher than a threshold voltage of the driving TFT.

Figure 11:
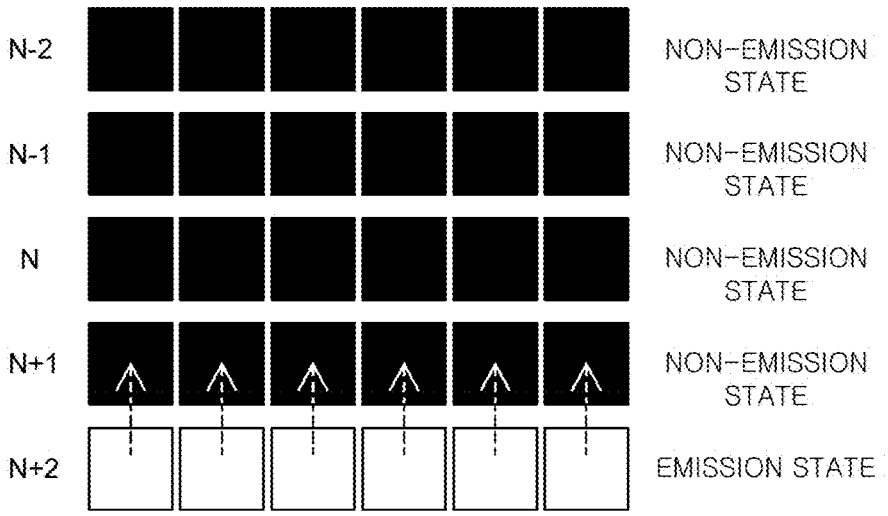

Then, FIG. 11 illustrates a case where when an Nth pixel row is in the sampling period t2 or in the programming period t3, N−1th, N−2th, and N+1 pixel rows among its adjacent pixel rows are in a non-emission state. Herein, a dotted arrow indicates an inflow route of a leakage current. Although FIG. 11 illustrates a line comprised of six pixels and five lines including an Nth pixel row and previous and subsequent two lines most adjacent to the Nth pixel row, it is obvious that such illustration is provided only for convenience in explanation and a configuration of lines and columns is not limited thereto.

To be more specific, when the Nth pixel row is in the sampling period t2 or in the programming period t3, (1) the N−2th and N−1th pixel rows are in the holding period t4, (2) the N+1th pixel row is in any one of the first initialization period t11 and the second initialization period t12, or in the first initialization period t11 and the second initialization period t12.

Figure 12A:
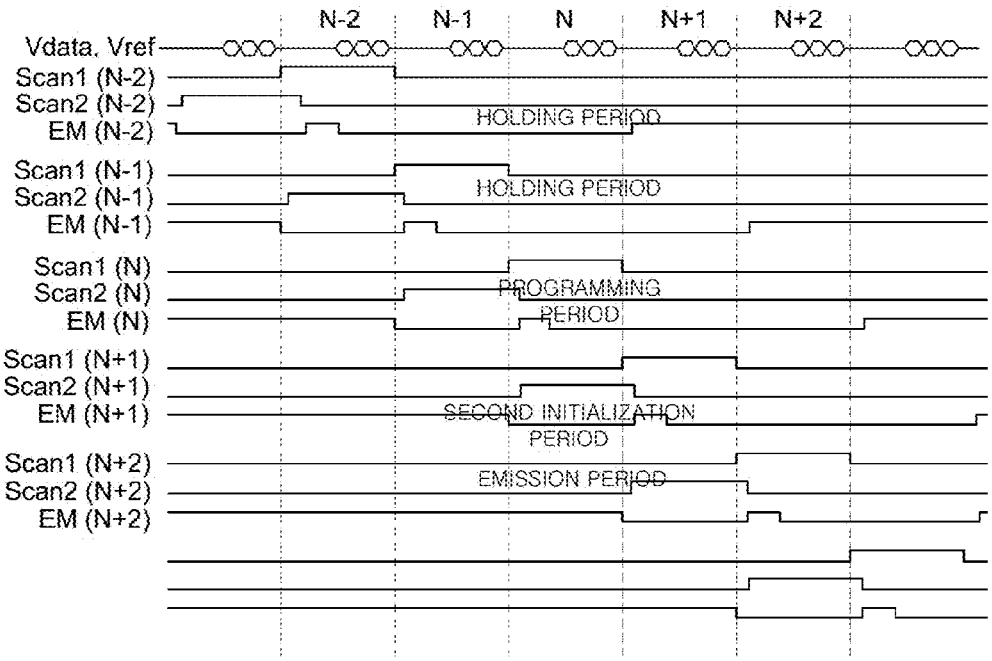
Figure 12B:
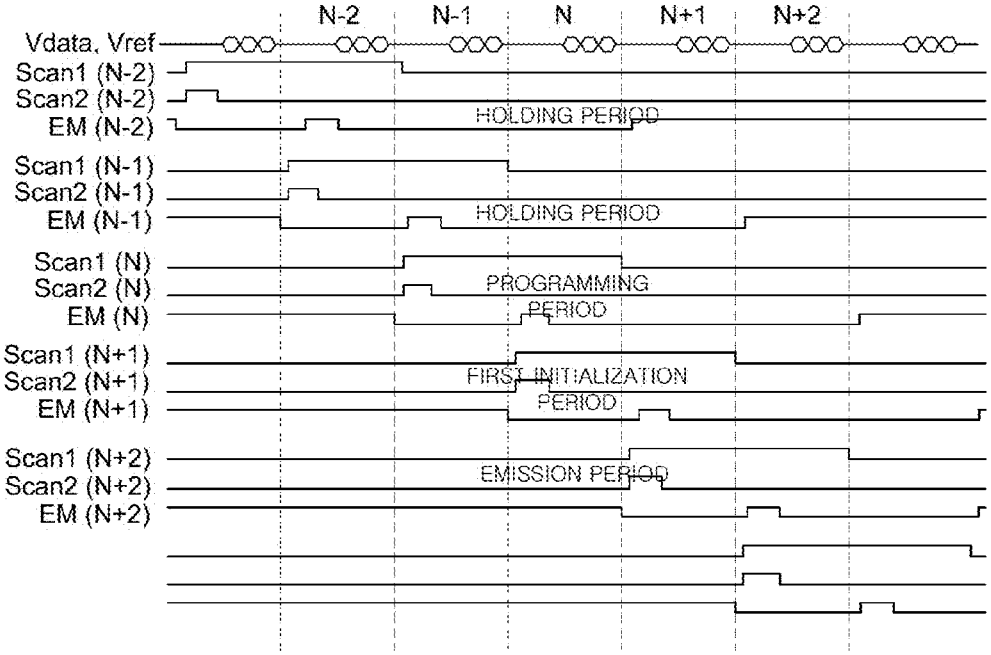

FIG. 12*a* and FIG. 12*b* are driving waveform diagrams illustrating a driving method of an Nth pixel row and pixel rows (for example, N−2th, N−1th, N+1th, and N+2th pixel rows) adjacent to the Nth pixel row. FIG. 12*a* and FIG. 12*b* are driving waveform diagrams for driving a display panel as illustrated in FIG. 11 if a pixel P adopts a 4T2C structure illustrated in FIG. 3 as a pixel driving circuit. That is, this is just an example, and the driving method according to an exemplary embodiment of the present disclosure as illustrated in FIG. 11 can also be applied to a pixel driving circuit of any other structure which drives a display panel as illustrated in FIG. 11 and operates in the first initialization period t11, the second initialization period t12, the initialization period t1, the sampling period t2, the programming period t3, the holding period t4, and the emission period t5 as described with reference to FIG. 2.

Referring to FIG. 12*a*, a driving timing may be controlled such that when the Nth pixel row is in the sampling period t2 or in the programming period t3, the N−2th and N−1th pixel rows are in the holding period t4 and the N+1th pixel row is in the second initialization period t12.

That is, referring to FIG. 12*a*, a driving timing may be controlled such that the second initialization period t12 starts earlier than the first initialization period t11 in each pixel P constituting a display panel of an OLED display device. However, in any case, the first initialization period t11 does not end earlier than the second initialization period t12.

Referring to FIG. 12*b*, a driving timing may be controlled such that when the Nth pixel row is in the sampling period t2 or in the programming period t3, the N−2th and N−1th pixel rows are in the holding period t4 and the N+1th pixel row is in the first initialization period t11.

That is, referring to FIG. 12*b*, a driving timing may be controlled such that each pixel P constituting a display panel of an OLED display device goes through only the first initialization period t11.

If a pixel P adopts a 4T2C structure illustrated in FIG. 3 as a pixel driving circuit, the first initialization period t11 and the second initialization period t12 cannot be completely overlapped in time, but if a pixel P adopts a pixel driving circuit of another structure, the first initialization period t11 and the second initialization period t12 may be completely overlapped in time, i.e., the initialization period t1 may be the first initialization period t11 or the second initialization period t12. That is, the first initialization period t11 and the second initialization period t12 may start and end at the same time. In other words, each pixel P may be driven such that an anode voltage of an OLED is lower than an OLED driving voltage while a voltage difference between a gate node and a source node of a driving TFT in each pixel P is higher than a threshold voltage of the driving TFT.

Figure 13:
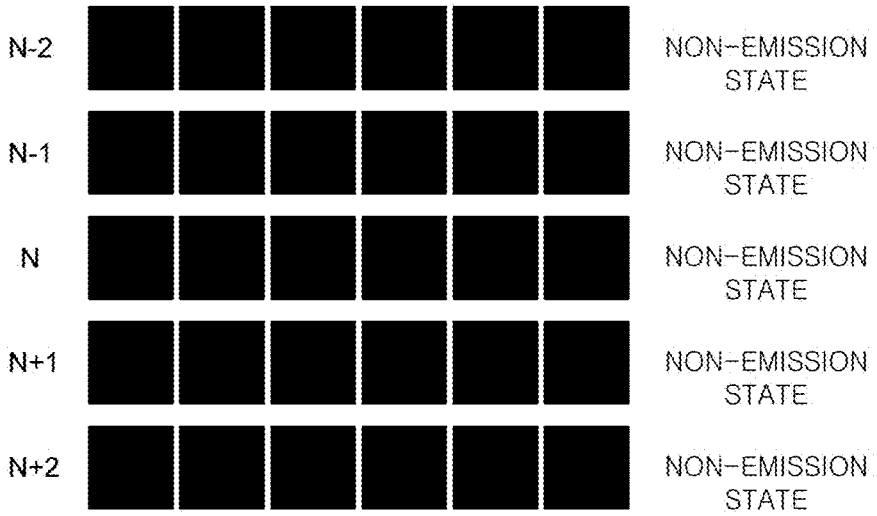

Then, FIG. 13 illustrates a case where when an Nth pixel row is in the sampling period t2 or in the programming period t3, N−1th, N−2th, N+1th, and N+2th pixel rows among its adjacent pixel rows are in a non-emission state. Herein, a dotted arrow indicates an inflow route of a leakage current. Although FIG. 13 illustrates a line comprised of six pixels and five lines including an Nth pixel row and previous and subsequent two lines most adjacent to the Nth pixel row, it is obvious that such illustration is provided only for convenience in explanation and a configuration of lines and columns is not limited thereto.

To be more specific, when the Nth pixel row is in the sampling period t2 or in the programming period t3, (1) the N−2th and N−1th pixel rows are in the holding period t4, (2) the N+1th and N+2th pixel rows are in any one of the first initialization period t11, the second initialization period t12, and the initialization period t1, or in the first initialization period t11 and the second initialization period t12.

Figure 14A:
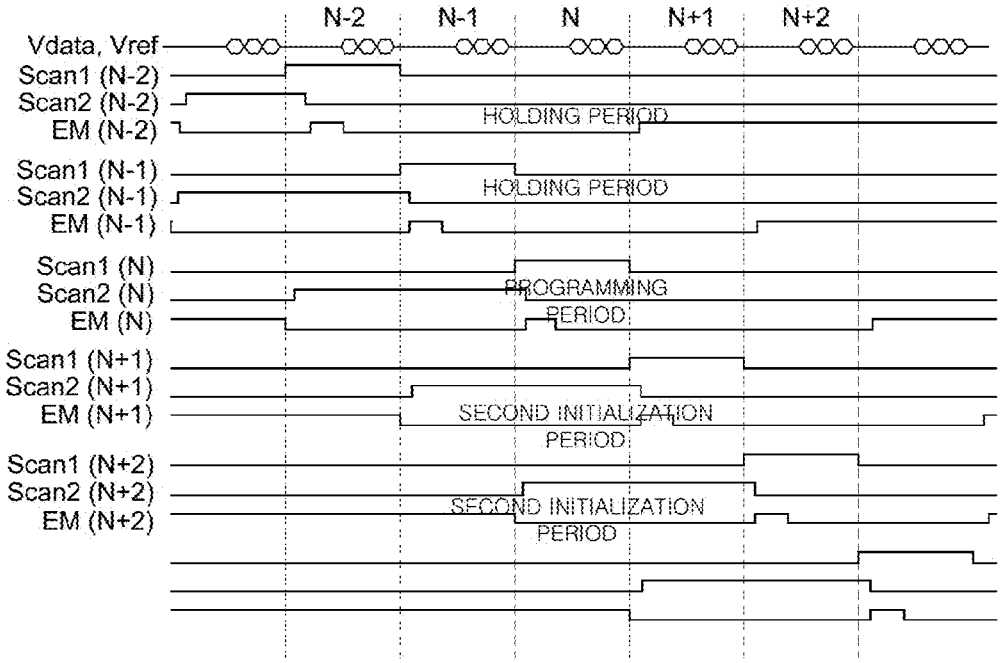
Figure 14B:
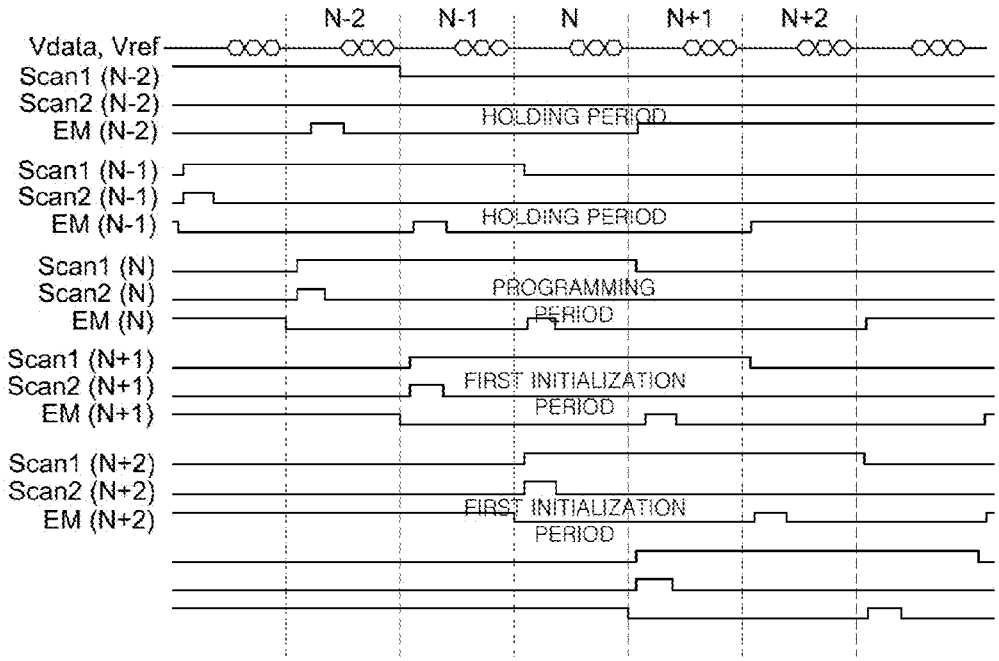

FIG. 14*a* and FIG. 14*b* are driving waveform diagrams illustrating a driving method of an Nth pixel row and pixel rows (for example, N−2th, N−1th, N+1th, and N+2th pixel rows) adjacent to the Nth pixel row. FIG. 14*a* and FIG. 14*b* are driving waveform diagrams for driving a display panel as illustrated in FIG. 13 if a pixel P adopts a 4T2C structure illustrated in FIG. 3 as a pixel driving circuit. That is, this is just an example, and the driving method according to an exemplary embodiment of the present disclosure as illustrated in FIG. 13 can also be applied to a pixel driving circuit of any other structure which drives a display panel as illustrated in FIG. 13 and operates in the first initialization period t11, the second initialization period t12, the initialization period t1, the sampling period t2, the programming period t3, the holding period t4, and the emission period t5 as described with reference to FIG. 2.

Referring to FIG. 14*a*, a driving timing may be controlled such that when the Nth pixel row is in the sampling period t2 or in the programming period t3, the N−2th and N−1th pixel rows are in the holding period t4 and the N+1th and N+2th pixel rows are in the second initialization period t12.

That is, referring to FIG. 14*a*, a driving timing may be controlled such that each pixel P constituting a display panel of an OLED display device goes through the holding period t4 over two horizontal periods 2H.

Further, referring to FIG. 14*a*, a driving timing may be controlled such that the second initialization period t12 starts earlier than the first initialization period t11 in each pixel P constituting a display panel of an OLED display device. However, in any case, the first initialization period t11 does not end earlier than the second initialization period t12.

Furthermore, referring to FIG. 14*a*, a driving timing may be controlled such that each pixel P constituting a display panel of an OLED display device goes through the second initialization period t12 over the two horizontal periods 2H.

Referring to FIG. 14*b*, a driving timing may be controlled such that when the Nth pixel row is in the sampling period t2 or in the programming period t3, the N−2th and N−1th pixel rows are in the holding period t4 and the N+1th and N+2th pixel rows are in the first initialization period t11.

That is, referring to FIG. 14*b*, a driving timing may be controlled such that each pixel constituting a display panel of an OLED display device goes through the holding period t4 over the two horizontal periods 2H.

Otherwise, referring to FIG. 14*b*, a driving timing may be controlled such that each pixel constituting a display panel of an OLED display device goes through only the first initialization period t11.

Further, referring to FIG. 14*b*, a driving timing may be controlled such that each pixel constituting a display panel of an OLED display device goes through the first initialization period t11 over the two horizontal periods 2H.

If a pixel P adopts a 4T2C structure illustrated in FIG. 3 as a pixel driving circuit, the first initialization period t11 and the second initialization period t12 cannot be completely overlapped in time. However, if a pixel P adopts a pixel driving circuit of another structure, the first initialization period t11 and the second initialization period t12 may be completely overlapped in time, i.e., the initialization period t1 may be the first initialization period t11 or the second initialization period t12. That is, the first initialization period t11 and the second initialization period t12 may start at the same time and end at the same time. In other words, each pixel P may be driven such that an anode voltage of an OLED is lower than an OLED driving voltage while a voltage difference between a gate node and a source node of a driving TFT in each pixel P is higher than a threshold voltage of the driving TFT.

In short, when an Nth pixel row constituting a display panel of an OLED display device is in the sampling period t2 or in the programming period t3, pixel rows adjacent to the Nth pixel row are set to be in a non-emission state. Thus, anode voltages of the adjacent pixel rows are set to be equal to or less than an anode voltage of the Nth pixel row, so that a leakage current introduced from the adjacent pixel rows to the Nth pixel row is minimized. In order to do so, a driving timing is controlled such that when the Nth pixel row is in the sampling period t2 or in the programming period t3, at least one of the previous pixel rows (for example, N−1th, N−2th, and N−3th pixel rows) adjacent to the Nth pixel row is in the holding period t4 and at least one of the subsequent adjacent pixel rows (for example, N+1th, N+2th, and N+3th pixel rows) adjacent to the Nth pixel row is in any one of the first initialization period t11 or the second initialization period t12, or in the first initialization period t11 and the second initialization period t12.

Figure 15:
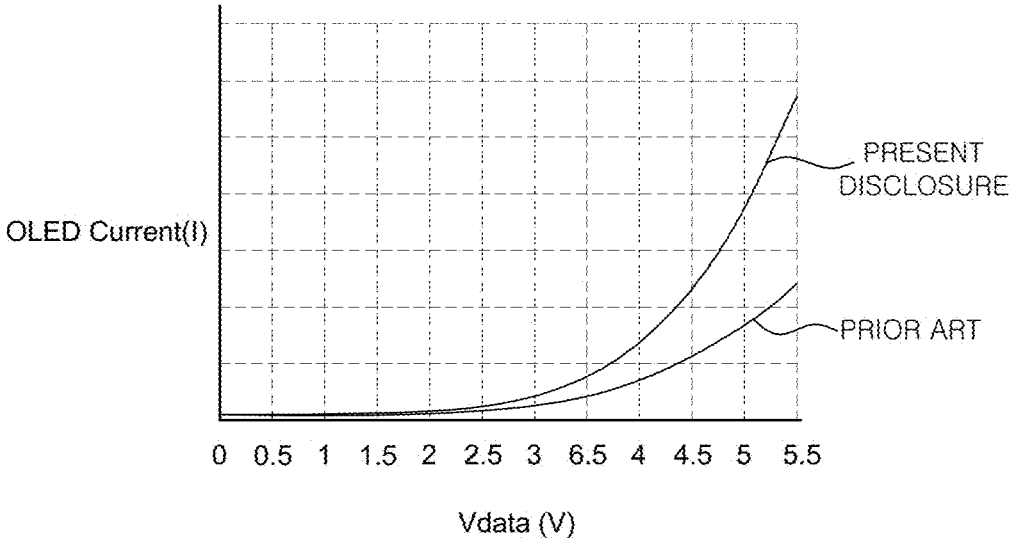
FIG. 15 is a graph comparing an I-V curve between a case where a pixel of an OLED display device is driven by a driving method of the present disclosure according to the driving waveform diagram of FIG. 8*a* and a case where the pixel is driven by a driving method of the prior art.

FIG. 15 is a graph comparing an I-V curve between a case where a pixel driving circuit configured according to a circuit diagram of FIG. 3 is driven by a driving method of the prior art (hereinafter, referred to as "prior art") and a case where the pixel driving circuit is driven by a driving method of an OLED display device of the present disclosure as illustrated in FIG. 7, according to the driving waveform diagram of FIG. 8*a* (hereinafter, referred to as "present disclosure").

It can be seen from FIG. 15 that when the same data driving voltage is applied, a higher current flows to the OLED in the present disclosure as compared with the prior art. Under the same data driving voltage condition, as a current flowing to the OLED is increased, a luminance is increased. This means that as compared with the prior art, in the present disclosure, even when a relatively low data driving voltage is applied, an equivalent luminance can be achieved. Thus, according to the present disclosure, it is possible to increase a margin of a data driving voltage.

Figure 16:
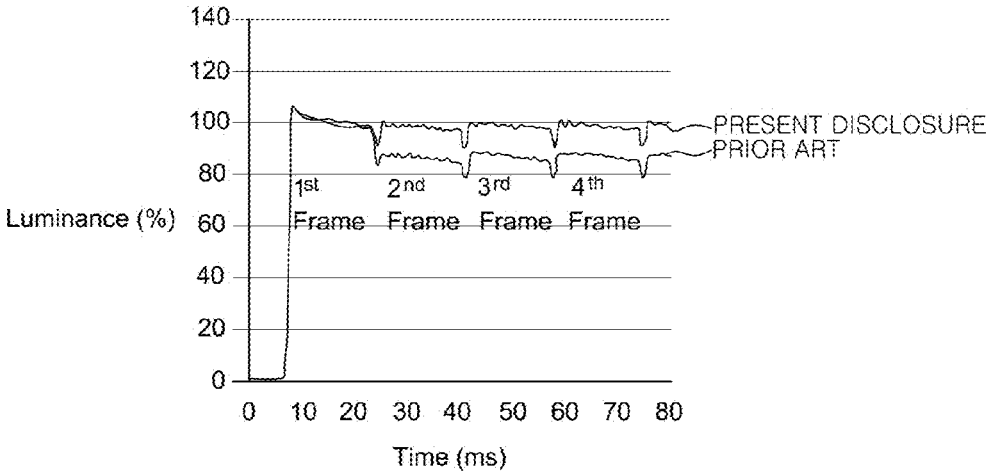
FIG. 16 is a graph comparing a response characteristic between a case where a driving method of the present disclosure is applied and a case where a driving method of the prior art is applied.

FIG. 16 is a graph comparing a response characteristic between a case where a driving method of the present disclosure is applied and a case where a driving method of the prior art is applied when a display panel including a pixel driving circuit configured according to a circuit diagram of FIG. 3 starts from a state where a black image is realized. Then it realizes a white image in a first frame, realizes a white image in a second frame and realizes a white image in a third frame.

Referring to FIG. 16, it can be seen that in the prior art, the luminance of the second frame and the third frame in which a white image is converted into a white image is lower than the luminance of the first frame in which a black image is converted into a white image. That is, the three frames displaying the same image are different in luminance depending images displayed in their respective previous frames. However, it can be seen that in the present disclosure, the luminance of the first frame is not different from the luminance of the second frame and the third frame and has an equivalent luminance. That is, it can be seen that the three frames displaying the same image have a constant and stable luminance regardless of images displayed in their respective previous frames.

The present disclosure is conceived to solve the above-described problem. In order to achieve the above-described object, an aspect of the present disclosure provides an OLED display device in which when an Nth pixel row is in a sampling period or a programming period, at least one pixel row of a previous pixel row or a subsequent pixel row adjacent to the Nth pixel row is in any one of (1) a holding period from after completion of writing data voltage to each of the at least one pixel row to before each of the at least one pixel row emits light, (2) a first initialization period in which a voltage difference between an anode and a cathode of an OLED included in each of the at least one pixel row has a lower value than an OLED driving voltage, and (3) a second initialization period in which a voltage difference between a gate node and a source node of a driving element that regulates an OLED driving voltage applied to an OLED included in each pixel of the at least one pixel row has a higher value than a threshold voltage of the driving element (e.g., the driving thin film transistor), or in the first initialization period and the second initialization period.

According to another feature of the present disclosure, when the Nth pixel row is in a sampling period or a programming period, the previous pixel row adjacent to the Nth pixel row is in a holding period.

According to yet another feature of the present disclosure, when the Nth pixel row is in a sampling period or a programming period, the subsequent pixel row adjacent to the Nth pixel row is in a second initialization period.

According to still another feature of the present disclosure, in the Nth pixel row, a second initialization period starts earlier than a first initialization period.

According to still another feature of the present disclosure, in the Nth pixel row, a first initialization period and a second initialization period start at the same time.

According to still another feature of the present disclosure, when the previous pixel row adjacent to the Nth pixel row is in a sampling period, a first initialization period or a second initialization period starts in the Nth pixel row. In other words, when an N−1th or N−2th pixel row is in a sampling period, a first initialization period or a second initialization period starts in the Nth pixel row.

According to still another feature of the present disclosure, in the Nth pixel row, a first initialization period and a second initialization period end at the same time.

According to still another feature of the present disclosure, a first initialization period or a second initialization period of the Nth pixel row starts before a sampling period of an N−1th pixel row.

According to still another feature of the present disclosure, the Nth pixel row goes through the first initialization period t11 over two horizontal periods 2H, the second initialization period t12 over two horizontal periods 2H, or the holding period t4 over two horizontal periods 2H.

According to still another feature of the present disclosure, when the Nth pixel row is in a sampling period or a programming period, an N−1th pixel row and an N−2th pixel row are in a holding period.

According to still another feature of the present disclosure, in the OLED display device, each of a plurality of pixels includes the OLED as a light emitting element and a pixel driving circuit that drives the light emitting element. Further, the pixel driving circuit includes: the driving element connected in series to the light emitting element in between a high-potential voltage supply line and a low-potential voltage supply line; a first switching element that connects a data line with a first node connected with a gate of the driving element in response to a first scan signal; a second switching element that connects an initialization voltage supply line with a second node connected with a source of the driving element in response to a second scan signal; a third switching element that connects the high-potential voltage supply line with a drain of the driving element in response to an emission signal; and a first capacitor connected between the first node and the second node, and the pixel driving circuit operates in a period divided into an initialization period in which when the third switching element is in an off state, the pixel driving circuit turns on the first and second switching elements, to initialize the first and second nodes, a sampling period in which the pixel driving circuit turns on the first and third switching elements, to sense a threshold voltage of the driving element, a programming period in which when the third switching element is in an off state, the pixel driving circuit turns on the first switching element, to write a data voltage to the pixel, a holding period from after completion of writing of a data voltage to the pixel to before the pixel emits a light, and an emission period in which the pixel driving circuit turns on the third switching element, to cause the driving element to supply a drive current to the light emitting element.

According to still another feature of the present disclosure, the initialization period includes a first initialization period or a second initialization period. The first initialization period is a period from when the first switching element and the second switching element are turned on in response to a first scan signal SCAN1 and a second scan signal SCAN2, respectively, to before the third switching element is turned on in response to an Emission signal EM. The second initialization period is a period in which the second switching element is turned on in response to the second scan signal SCAN2 before the first switching element is turned on in response to the first scan signal SCAN1.

According to still another feature of the present disclosure, in the first initialization period, before the third switching element is turned on in response to the Emission signal EM, the second switching element is turned off in response to the second scan signal SCAN2. Or when the third switching element is turned on in response to the Emission signal EM, the second switching element is turned off in response to the second scan signal SCAN2.

In order to achieve the above-described object, another aspect of the present disclosure provides an apparatus comprising a circuit configured to control anode voltages of one or more adjacent pixel rows, which are adjacent to an Nth pixel row, to achieve minimal voltage differences between said Nth pixel row and said adjacent pixel rows to suppress luminance drops in an OLED display by minimizing leakage currents being introduced from adjacent pixel rows, said circuit configured to set said anode voltages of said one or more adjacent pixel rows to be equal to or less than an anode voltage of said Nth pixel row when said Nth pixel row is operating in a sampling period or in a programming period among driving operation periods of said OLED display.

According to another feature of the present disclosure, said setting of anode voltages is supported by a timing controller configured to receive image data and synchronization signals from an external source, output converted data voltages to a data driver for driving thereof via a plurality of data lines, and output gate control signals to a gate driver for driving thereof via a plurality of gate lines, such that a holding period is added after the programming period but before an emission period among said driving operation periods of said OLED display, which serves the purpose of setting at least one previous pixel row of the Nth pixel row to a non-emission state at the programming period of the Nth pixel row to create a time delay between a completion of writing of a data voltage to a pixel before light emission of the pixel.

According to yet another feature of the present disclosure, said setting of anode voltages is supported by a timing controller configured to receive image data and synchronization signals from an external source, output the image data to a data driver for driving a plurality of data lines, and output gate control signals to a gate driver for driving plurality of gate lines, such that a second initialization period, in which a second switching element connected to an initialization voltage supply line is turned on in response to a second scan signal before a first switching element connected to a data line is turned on in response to a first scan signal, is added into an initialization period during which initializing of a pixel is performed, said second initialization period serving the purpose of setting at least one subsequent pixel row of the Nth pixel row to a non-emission state at the programming period of the Nth pixel row to create a time margin between light emission of a pixel and sensing of a threshold voltage of a driving element configured to supply a drive current to an OLED.

According to still another feature of the present disclosure, the second initialization period allows for a voltage to be applied between an anode and a cathode of the OLED, said voltage having a lower value than the threshold driving voltage of the OLED.

According to still another feature of the present disclosure, said setting of anode voltages is supported by the gate driver configured to receive the gate control signals from the timing controller, the gate control signals including a first scan signal, a second scan signal and an emission signal which are output to each pixel via the plurality of gate lines, respectively.

According to still another feature of the present disclosure, said setting of anode voltages is supported by the data driver configured to receive the image data and the data control signals from the timing controller, and output converted data voltages to each pixel via the plurality of data lines, respectively.

According to still another feature of the present disclosure, said setting of anode voltages is supported by a display panel comprising a plurality of pixels, with each pixel including a pixel driving circuit defined with respect to an intersection of a plurality of gate lines and a plurality of data lines, and each pixel is connected to the gate lines, the data lines, a high-potential voltage supply line, a low-potential voltage supply line, and an initialization voltage supply line.

The present disclosure provides an OLED display device that has a reduced luminance deviation between pixels since a driving TFT characteristic deviation and a drop voltage of a high-potential voltage VDD are compensated.

The present disclosure provides an OLED display device that has an improved image quality since a luminance deviation between pixels is reduced.

The present disclosure provides an OLED display device that has an increased margin of a data driving voltage since even when a relatively low data driving voltage is applied, an equivalent luminance is achieved.

Further, the present disclosure provides an OLED display device that has a constant and stable luminance since three frames displaying the same image regardless of images are displayed in their respective previous frames. Accordingly, the present disclosure provides an OLED display device that has an excellent response characteristic.

The present disclosure is not limited to the above-described exemplary embodiment and the accompanying drawings, and it is obvious to those skilled in the art that various substitutions, modifications, and changes can be made without departing from the scope of the present disclosure.

What is claimed is:

1. An organic light emitting diode (OLED) display device comprising:

a display panel including a plurality of pixels located near a plurality of gate lines and a plurality of data lines;

a gate driver supplying a plurality of gate signals to the plurality of gate lines;

a data driver supplying a data voltage to the plurality of data lines, and a timing controller generating a plurality of gate control signals for driving the gate driver and a plurality of data control signals for driving the data driver;

wherein each pixel of the plurality of pixels operates in a plurality of periods divided into an initialization period, a sampling period, a programming period, a holding period and an emission period, in response to the plurality of gate signals supplied to the pixel, the initialization period including a first initialization period and a second initialization period, wherein when an Nth pixel row is in the sampling period or the programming period, at least one pixel row of a previous pixel row or a subsequent pixel row adjacent to the Nth pixel row is in any one of the holding period from after completion of writing of a data voltage to each of the at least one pixel row to before each of the at least one pixel row emits a light, the first initialization period in which a voltage of an anode of an organic light emitting diode included in each of the at least one pixel row has a lower value than an organic light emitting diode driving voltage, and the second initialization period in which a voltage difference between a gate node and a source node of a driving element that regulates an organic light emitting diode driving voltage applied to an organic light emitting diode included in each of the at least one pixel row has a higher value than a threshold voltage of the driving element, or in the first initialization period and the second initialization period, wherein N is equal to or greater than 1, wherein the each of a plurality of pixels includes a pixel driving circuit, and the pixel driving circuit includes:

the driving element connected in series to the light emitting element in between a high-potential voltage supply line and a low-potential voltage supply line;

a first transistor that connects a data line with a first node connected with a gate of the driving element in response to a first scan signal;

a second transistor that connects an initialization voltage supply line with a second node connected with a source of the driving element in response to a second scan signal;

a third transistor that connects the high-potential voltage supply line with a drain of the driving element in response to an emission signal; and a first capacitor connected between the first node and the second node, and the pixel driving circuit operates in a period divided into the initialization period in which when the third transistor is in an off state, the pixel driving circuit turns on the first and second transistors, to initialize the first and second nodes, the sampling period in which the pixel driving circuit turns on the first and third transistors, to sense a threshold voltage of the driving element, the programming period in which when the third transistor is in an off state, the pixel driving circuit turns on the first transistor, to write a data voltage to the pixel, the holding period in which when the first, the second and the third transistors are in an off state, the holding period from after completion of writing of a data voltage to the pixel to before the pixel emits a light, and the emission period in which the pixel driving circuit turns on the third transistor, to cause the driving element to supply a drive current to the light emitting element.

2. The organic light emitting diode display device according to claim 1, wherein when the Nth pixel row is in the sampling period or the programming period, the previous pixel row adjacent to the Nth pixel row is in the holding period.

3. The organic light emitting diode display device according to claim 1, wherein when the Nth pixel row is in the sampling period or the programming period, the subsequent pixel row adjacent to the Nth pixel row is in the second initialization period.

4. The organic light emitting diode display device according to claim 1, wherein in the Nth pixel row, the second initialization period starts earlier than the first initialization period.

5. The organic light emitting diode display device according to claim 1, wherein in the Nth pixel row, the first initialization period and the second initialization period start at the same time.

6. The organic light emitting diode display device according to claim 5, wherein in the Nth pixel row, the first initialization period and the second initialization period end at the same time.

7. The organic light emitting diode display device according to claim 1, wherein when the previous pixel row adjacent to the Nth pixel row is in the sampling period, the first initialization period or the second initialization period starts in the Nth pixel row.

8. The organic light emitting diode display device according to claim 7, wherein when an N−1th or N−2th pixel row is in the sampling period, the first initialization period or the second initialization period starts in the Nth pixel row.

9. The organic light emitting diode display device according to claim 1, wherein the first initialization period or the second initialization period of the Nth pixel row starts before a sampling period of an N−1th pixel row.

10. The organic light emitting diode display device according to claim 1, wherein the Nth pixel row goes through the first initialization period over two horizontal periods, or the second initialization period over two horizontal periods.

11. The organic light emitting diode display device according to claim 1, wherein the Nth pixel row goes through the holding period, over two horizontal periods.

12. The organic light emitting diode display device according to claim 1, wherein when the Nth pixel row is in the sampling period or the programming period, an N−1th pixel row and an N−2th pixel row are in a holding period, wherein N is equal to or greater than 2.

13. The organic light emitting diode display device according to claim 1, wherein the first initialization period is a period from when the first transistor and the second transistor are turned on in response to a first scan signal and a second scan signal, respectively, to before the third transistor is turned on in response to an emission signal, and the second initialization period is a period in which the second transistor is turned on in response to the second scan signal before the first transistor is turned on in response to the first scan signal.

14. The organic light emitting diode display device according to claim 1, wherein in the first initialization period, before the third transistor is turned on in response to the emission signal, the second transistor is turned off in response to the second scan signal, or when the third transistor is turned on in response to the emission signal, the second transistor is turned off in response to the second scan signal.

15. The organic light emitting diode display device according to claim 1, wherein the pixel driving circuit includes:

a second capacitor connected between the high-potential voltage supply line and the second node.

16. The organic light emitting diode display device according to claim 15, wherein a second capacitor is connected to the first capacitor in series to reduce a capacity ratio of the first capacitor.

* * * * *